US011127351B2

(12) United States Patent
Miwa et al.

(10) Patent No.: US 11,127,351 B2
(45) Date of Patent: Sep. 21, 2021

(54) DISPLAY DEVICE AND METHOD OF DRIVING THE SAME USING FAKE DATA INSERTION

(71) Applicant: LG Display Co., Ltd., Seoul (KR)

(72) Inventors: Koichi Miwa, Gyeonggi-do (KR); SeungJoon Jeon, Gyeonggi-do (KR); NakJin Seong, Gyeonggi-do (KR); MinHyung Kang, Gyeonggi-do (KR); MooKyoung Hong, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 111 days.

(21) Appl. No.: 16/415,596

(22) Filed: May 17, 2019

(65) Prior Publication Data

US 2019/0355309 A1 Nov. 21, 2019

(30) Foreign Application Priority Data

May 21, 2018 (KR) ..... 10-2018-0057678

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2300/0413* (2013.01); *G09G 2300/0439* (2013.01); *G09G 2310/0205* (2013.01); *G09G 2310/0251* (2013.01); *G09G 2310/08* (2013.01)

(58) Field of Classification Search
CPC ..... G09G 3/30; G09G 3/32; G09G 3/3208; G09G 3/3225; G09G 3/3233; G09G 3/325; G09G 3/3258; G09G 3/3266; G09G 3/3275; G09G 3/3283; G09G 3/3291; G09G 2230/00; G09G 2300/0413; G09G 2300/0439; G09G 2310/0205; G09G 2310/0245; G09G 2310/0248; G09G 2310/0251; G09G 2310/061; G09G 2310/062; G09G 2310/063; G09G 2310/067; G09G 2310/08; G09G 2320/02; G09G 2320/0233
See application file for complete search history.

(56) References Cited

U.S. PATENT DOCUMENTS

2005/0168491 A1* 8/2005 Takahara ..... G09G 3/3241 345/690
2016/0078834 A1* 3/2016 Hong ..... G09G 3/20 345/212
2018/0061296 A1* 3/2018 Shim ..... G09G 3/3233
2018/0261161 A1* 9/2018 Ota ..... G09G 3/3233
2019/0108789 A1* 4/2019 Tsuge ..... G09G 3/3233
2019/0333464 A1* 10/2019 Horiuchi ..... H01L 27/124
2020/0035165 A1* 1/2020 Park ..... G09G 3/3266
2020/0143752 A1* 5/2020 Jung ..... G09G 3/3275

* cited by examiner

*Primary Examiner* — Keith L Crawley
(74) *Attorney, Agent, or Firm* — Seed IP Law Group LLP

(57) ABSTRACT

A display device and a method of driving the same. Overlap driving of overlapping subpixels, and fake data insertion driving of inserting a fake image, different from real images, into every line of a plurality of lines, are performed, thereby improving image quality.

22 Claims, 23 Drawing Sheets

DISPLAY DEVICE AND METHOD OF DRIVING THE SAME USING FAKE DATA INSERTION

CROSS REFERENCE TO RELATED APPLICATION

This application claims priority to Korean Patent Application No. 10-2018-0057678, filed on May 21, 2018, which is hereby incorporated by reference for all purposes as if fully set forth herein.

BACKGROUND

Technical Field

Exemplary embodiments relate to a display device and a method of driving the same.

Description of the Related Art

In response to the development of the information society, demand for a variety of types of display devices for displaying images is increasing. In this regard, a range of display devices, such as liquid crystal display (LCD) devices, plasma display devices, and organic light-emitting diode (OLED) display devices, have recently come into widespread use.

Such a display device can perform display driving by charging capacitors respectively disposed in each subpixel among a plurality of subpixels arrayed in a display panel. However, in display devices of the related art, some subpixels may be insufficiently charged, thereby degrading image quality, which is problematic. In addition, in the related art, an image may be blurred instead of being clearly distinguishable, or luminance differences may be caused due to different emission periods depending on line position, thereby degrading image quality.

BRIEF SUMMARY

Various aspects of the present disclosure provide a display device and a method of driving the same that can improve the state of charge by performing overlap driving of overlapping subpixels, thereby improving image quality.

Also provided are a display device and a method of driving the same that can reduce or prevent luminance differences due to image blurring or different emission periods depending on line position by fake data insertion (FDI) driving of inserting a fake image, different from real images, into every line of a plurality of lines, thereby improving image quality.

Also provided are a display device and a method of driving the same that can combine the overlap driving and the fake data insertion driving, thereby further improving image quality.

Also provided are a display device and a method of driving the same that can prevent the periodic appearance of bright stripes, which may be caused by combined application of the overlap driving the fake data insertion driving, immediately before the insertion of fake data, thereby further improving image quality.

Also provided are a dummy subpixel structure able to prevent the periodic appearance of bright stripes, which may be caused by a combined application of the overlap driving and the fake data insertion driving, immediately before the insertion of fake data, thereby further improving image quality, as well as a display device and a method of driving the same that use the dummy subpixel structure in driving.

According to an aspect of the present disclosure, a display device may include a display panel in which a plurality of data lines and a plurality of gate lines are disposed, and a plurality of subpixels are arrayed.

A video data voltage for video display may be supplied sequentially to a first subpixel, a second subpixel, and a third subpixel among the plurality of subpixels through a first data line among the plurality of data lines.

The first subpixel, the second subpixel, and the third subpixel may be arrayed in the same column.

The driving period of the first subpixel may overlap the driving period of the second subpixel, while the driving period of the second subpixel may not overlap the driving period of the third subpixel.

The front portion of the driving period of the first subpixel may overlap the rear portion of the driving period of the previous subpixel. The rear portion of the driving period of the first subpixel may overlap the front portion of the driving period of the second subpixel.

In contrast, the front portion of the driving period of the second subpixel may overlap the rear portion of the driving period of the first subpixel, disposed ahead of the second subpixel. However, the rear portion of the driving period of the second subpixel may not overlap the front portion of the driving period of the third subpixel.

The driving period of the first subpixel may be a period in which a scanning signal having a turn-on level is supplied to the first subpixel. The driving period of the second subpixel may be a period in which the scanning signal having a turn-on level is supplied to the second subpixel. The driving period of the third subpixel may be a period in which the scanning signal having a turn-on level is supplied to the third subpixel.

A data voltage distinguishable or different from the video data voltage may be supplied to the first data line during a fake data insertion period between the driving period of the second subpixel and the driving period of the third subpixel.

The display panel may further include a dummy subpixel arrayed in the same column as the first subpixel, the second subpixel, and the third subpixel.

The dummy subpixel may be driven during an assist driving period corresponding to a portion of the driving period of the second subpixel that does not overlap the driving period of the first subpixel.

The dummy subpixel may be located opposite a portion in the display panel, to which the driver circuit is connected.

The fake data voltage supplied to the first data line may correspond to a black data voltage.

Two or more subpixels different from the first subpixel, the second subpixel, and the third subpixel may be further arrayed in the column in which the first to third subpixels are arrayed.

The two or more subpixels may be sequentially driven before the first to third subpixels to be sequentially supplied with the video data voltage before the first to third subpixels. Afterwards, the two or more subpixels may be supplied with the fake data voltage distinguishable or different from the video data voltage through the first data line.

Each of two or more subpixels may emit light in response to the video data voltage and may not emit light in response to the fake data voltage.

During the assist driving period, current may flow in the second subpixel and the dummy subpixel.

During the assist driving period, as the dummy subpixel is driven, the video data voltage supplied to the second subpixel may be transferred to the dummy subpixel through the first data line.

The display panel may include a signal line through which a dummy clock signal for driving the dummy subpixel is transferred.

The display panel may include a first reference voltage line through which a reference voltage is supplied to the first subpixel, the second subpixel, the third subpixel, and the dummy subpixel.

Before the assist driving period, a combined current of a current generated from the first subpixel and a current generated from the second subpixel may flow through the first reference voltage line.

During the assist driving period, a combined current of the current generated from the second subpixel and a current generated from the dummy subpixel may flow through the first reference voltage line.

The voltage of the first reference voltage line during the assist driving period may correspond to the voltage of the first reference voltage line before the assist driving period.

Each of the first subpixel, the second subpixel, and the third subpixel may include: an organic light-emitting diode having a first electrode and a second electrode; a driving transistor driving the organic light-emitting diode; a first transistor controlled by a first scanning signal, and electrically connected between a first node of the driving transistor and the first data line; a second transistor controlled by a second scanning signal, and electrically connected between a second node of the driving transistor and the first reference voltage line; and a storage capacitor electrically connected between the first node and the second node of the driving transistor.

A voltage difference between the first node and the second node of the driving transistor in the second subpixel during the assist driving period may correspond to a voltage difference between the first node and the second node of the driving transistor in the second subpixel before the assist driving period.

The dummy subpixel may include: a dummy capacitor having a first electrode and a second electrode; and a dummy transistor controlled by a first dummy scanning signal, which is a dummy clock signal for driving the dummy subpixel, the dummy transistor being electrically connected between a first electrode of the dummy capacitor and the first reference voltage line.

The dummy capacitor may have a greater capacitance than a storage capacitor disposed in each of the plurality of subpixels.

The dummy subpixel may further include: a dummy driving transistor electrically connected between the first electrode of the dummy capacitor and a driving voltage line; a dummy scanning transistor controlled by a second dummy scanning signal, which is the dummy clock signal, the dummy scanning transistor being electrically connected between a first node of the dummy driving transistor and the first data line; and a dummy storage capacitor electrically connected between the first node and a second node of the dummy driving transistor.

The dummy subpixel may further include: a dummy driving transistor electrically connected between the first electrode of the dummy capacitor and a driving voltage line; and a dummy storage capacitor electrically connected between a first node and a second node of the dummy driving transistor.

The first node of the dummy driving transistor may be electrically connected to the first data line.

The dummy subpixel may further include a dummy capacitor having a first electrode and a second electrode, wherein the first electrode of the dummy capacitor is electrically connected to the first reference voltage line, and a dummy clock signal for driving the dummy subpixel is applied to the second electrode of the dummy capacitor.

The dummy capacitor may have a greater capacitance than a storage capacitor disposed in each of the plurality of subpixels.

The dummy subpixel may further include a dummy driving transistor electrically connected between the first electrode and the second electrode of the dummy capacitor.

The gate node of the dummy driving transistor may be electrically connected to the first data line. The dummy clock signal may be applied to a source node or a drain node of the dummy driving transistor. The first reference voltage line may be electrically connected to the drain node or the source node of the dummy driving transistor.

The dummy subpixel may further include a dummy driving transistor electrically connected between the first electrode and the second electrode of the dummy capacitor.

A gate node of the dummy driving transistor may be electrically connected to a drain node or a source node of the dummy driving transistor. The dummy clock signal may be applied to the drain node or the source node of the dummy driving transistor. The first reference voltage line may be electrically connected to the source node or the drain node of the dummy driving transistor.

According to another aspect of the present disclosure, a display device may include: a display panel in which a plurality of data lines and a plurality of gate lines are disposed, and a plurality of subpixels are arrayed; and a driver circuit driving the display panel.

The plurality of subpixels may be provided in two or more subpixel rows, in each of which a dummy subpixel is disposed.

The driver circuit may drive the dummy subpixel by synchronization with points in time at which subpixels, among the plurality of subpixels, in each of the subpixel columns, are driven.

The dummy subpixel may be located opposite a portion in the display panel, to which the driver circuit is electrically connected.

During one frame, the driver circuit may supply a video data voltage to a subpixel among the subpixels in each of the subpixel rows, and then supply a fake data voltage to the other subpixels arrayed in each of the subpixel rows.

The driver circuit may drive the dummy subpixel when supplying the video data voltage to the subpixel before supplying the fake data voltage to the other subpixels.

The fake data voltage may correspond to a black data voltage.

According to another aspect of the present disclosure, provided a method of driving a display device. The display device includes a display panel, in which a plurality of data lines and a plurality of gate lines are disposed, and a plurality of subpixels formed adjacent to a location where the plurality of data lines and the plurality of gate lines are arrayed, a data driver circuit driving the plurality of data lines, and a gate driver circuit driving the plurality of gate lines.

The method may include: supplying a video data voltage to a subpixel among the plurality of subpixels during a first frame; and supplying a fake data voltage to other subpixels, among the plurality of subpixels, arrayed in the same column as the subpixel during the first frame.

The method may further include driving a dummy subpixel arrayed in the same column as the subpixel when supplying the video data voltage to the subpixel before supplying the fake data voltage to the other subpixels.

According to another aspect of the present disclosure, a display device may include: a display panel, in which a plurality of data lines and a plurality of gate lines are disposed, and a plurality of subpixels formed adjacent to a location where the plurality of data lines and the plurality of gate lines are arrayed; a data driver circuit driving the plurality of data lines; and a gate driver circuit driving the plurality of gate lines.

At a first point in time, a first pre-charge data voltage may be supplied to a first subpixel through a first data line.

At a second point in time after the first point in time, a first video data voltage may be supplied to the first subpixel through the first data line, and a second pre-charge data voltage may be supplied to a second subpixel through the first data line.

At a third point in time after the second point in time, a second video data voltage may be supplied to the second subpixel through the first data line, and a dummy subpixel, arrayed in the same column as the first subpixel, the second subpixel, and a third subpixel, may be driven.

At a fourth point in time after the third point in time, a fake data voltage may be supplied to the first data line.

At a fifth point in time after the fourth point in time, a third pre-charge data voltage may be supplied to the third subpixel through the first data line.

At a sixth point in time after the fifth point in time, a third video data voltage may be supplied to the third subpixel through the first data line, and a fourth pre-charge data voltage may be supplied to the fourth subpixel through the first data line.

The interval between the first point in time and the second point in time, the interval between the second point in time and the third point in time, the interval between the third point in time and the fourth point in time, the interval between the fourth point in time and the fifth point in time, and the interval between the fifth point in time and the sixth point in time may have the same lengths.

According to exemplary embodiments, the display device and the method of driving the same can improve the state of charge by performing overlap driving of the subpixels, thereby improving image quality.

According to exemplary embodiments, the display device and the method of driving the same can reduce or prevent luminance differences due to image blurring or different emission periods depending on line position by fake data insertion (FDI) driving of inserting a fake image, different from real images, into every line of a plurality of lines, thereby improving image quality.

According to exemplary embodiments, the display device and the method of driving the same can combine the overlap driving and the fake data insertion driving, thereby further improving image quality.

According to exemplary embodiments, the display device and the method of driving the same can prevent the periodic appearance of bright stripes, which may be caused by combined application of the overlap driving the fake data insertion driving, immediately before the insertion of fake data, thereby further improving image quality.

According to exemplary embodiments, the dummy subpixel structure can prevent the periodic appearance of bright stripes, which may be caused by a combined application of the overlap driving and the fake data insertion driving, immediately before the insertion of fake data, thereby further improving image quality. The display device and the method of driving the same use the dummy subpixel structure in driving.

BRIEF DESCRIPTION OF THE DRAWINGS

The above and other objects, features, and advantages of the present disclosure will be more clearly understood from the following detailed description when taken in conjunction with the accompanying drawings, in which.

DETAILED DESCRIPTION

Figure 1:
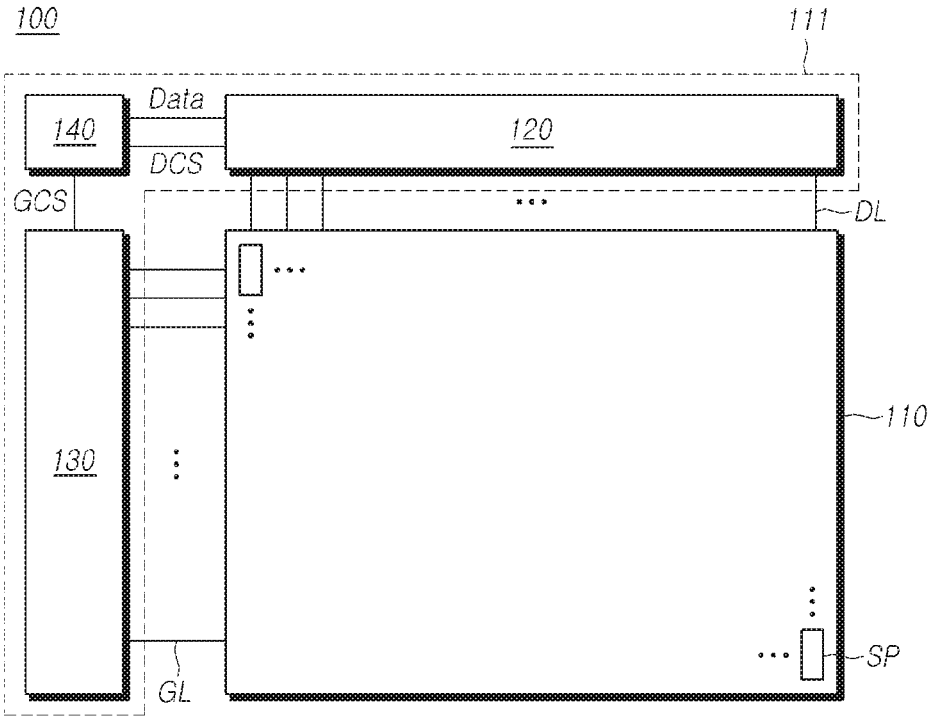
FIG. 1 illustrates a schematic configuration of a display device according to exemplary embodiments.

The present disclosure may provide a display device and a method of driving the same, the display device including a display panel, in which a plurality of data lines and a plurality of gate lines are disposed, and a plurality of subpixels formed adjacent to a location where the plurality of data lines and the plurality of gate lines are arrayed, and a driver circuit driving the display panel.

The plurality of subpixels, arrayed in the display panel, are grouped into two or more subpixel columns, in each of which a dummy subpixel may be disposed.

The driver circuit may drive the dummy subpixels by synchronization with points in time at which the subpixels in each of the subpixel columns are driven.

The driving of the dummy subpixels by synchronization with points in time at which the subpixels are driven can control, reduce, or remove any degradation in image quality, which would occur due to driving of other subpixels.

Hereinafter, reference will be made to embodiments of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated herein will be omitted in the case that the subject matter of the present disclosure may be rendered unclear thereby.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element.

FIG. 1 illustrates a schematic configuration of a display device 100 according to exemplary embodiments.

Referring to FIG. 1, the display device 100 according to exemplary embodiments includes a display panel 110 and a driver circuit 111 driving the display panel 110. In the display panel 110, a plurality of data lines DL and a plurality of gate lines GL are disposed, and a plurality of subpixels SP formed adjacent to locations where the plurality of data lines DL and the plurality of gate lines GL overlaps.

The driver circuit 111, in terms of the function, may include a data driver circuit 120 driving the plurality of data lines DL, a gate driver circuit 130 driving the plurality of gate lines GL, and a controller 140 controlling the data driver circuit 120 and the gate driver circuit 130.

In the display panel 110, the plurality of data lines DL and the plurality of gate lines GL may overlap with each other. For example, the plurality of data lines DL may be disposed in rows or columns, while the plurality of gate lines GL may be disposed in columns or rows. Hereinafter, the plurality of data lines DL will be regarded as being disposed in rows, while the plurality of gate lines GL will be regarded as being disposed in columns, for the sake of brevity.

The controller 140 controls the data driver circuit 120 and gate driver circuit 130 by transferring a variety of control signals DCS and GCS for driving of the data driver circuit 120 and gate driver circuit 130, respectively.

The controller 140 starts scanning at points in time defined by frames, outputs converted video data Data by converting video data input from an external source into a data signal format readable by the data driver circuit 120, and controls data driving at appropriate points in time in response to the scanning.

The controller 140 receives a variety of timing signals, including a vertical synchronization signal Vsync, a horizontal synchronization signal Hsync, an input data enable signal DE, and a clock signal CLK, in addition to the input video data, from an external source (e.g., a host system).

The controller 140 not only outputs converted video data Data by converting video data input from an external source into a data signal format readable by the data driver circuit 120, but also receives timing signals, such as a vertical synchronization signal Vsync, a horizontal synchronization signal Hsync, an input data enable signal DE, and a clock signal CLK, and generates and outputs a variety of control signals to the data driver circuit 120 and gate driver circuit 130 in order to control the data driver circuit 120 and the gate driver circuit 130.

For example, the controller 140 outputs a variety of gate control signals GCS, including a gate start pulse GSP, a gate shift clock GSC, a gate output enable signal GOE, and the like, to control the gate driver circuit 130.

Here, the gate start pulse GSP is used to control the operation start timing of one or more gate driver integrated circuits (ICs) of the gate driver circuit 130. The gate shift clock GSC is a clock signal commonly input to the one or more gate driver ICs to control the shift timing of scanning signals. The gate output enable signal GOE designates timing information of the one or more gate driver ICs.

In addition, the controller 140 outputs a variety of data control signals DCS, including a source start pulse SSP, a source sampling clock SSC, a source output enable signal SOE, and the like, to control the data driver circuit 120.

Here, the source start pulse SSP is used to control the data sampling start timing of one or more source driver ICs of the data driver circuit 120. The source sampling clock SSC is a clock signal controlling the sampling timing of data in each of the source driver ICs. The source output enable signal SOE controls the output timing of the data driver circuit 120.

The controller 140 may be a timing controller used in typical display technology, or may be a control device including a timing controller and performing other control functions.

The controller 140 may be provided as a component separate from the data driver circuit 120, or may be provided as an IC combined (or integrated) with the data driver circuit 120.

The controller 140 may be implemented using any suitable electronic circuits capable of performing the operations detailed herein (e.g., microprocessor, circuitry, or the like).

The data driver circuit 120 receives video data Data from the controller 140 and supplies a data voltage to the plurality of data lines DL to drive the plurality of data lines DL. Herein, the data driver circuit 120 may also be referred to as a source driver circuit.

The data driver circuit 120 may include one or more source driver ICs.

Each of the source driver ICs may include a shift register, a latch circuit, a digital-to-analog converter (DAC), an output buffer, and the like.

In some cases, each of the source driver ICs may further include one or more analog-to-digital converters (ADCs).

Each of the source driver ICs may be connected to a bonding pad of the display panel 110 by a tape-automated bonding (TAB) method or by a chip-on-glass (COG) method, may be directly mounted on the display panel 110, or in some cases, may be integrated with the display panel 110. In addition, each of the source driver ICs may be implemented using a chip-on-film (COF) structure mounted on a film connected to the display panel 110.

The gate driver circuit 130 sequentially drives the plurality of gate lines GL by sequentially supplying a scanning signal to the plurality of gate lines GL. Herein, the gate driver circuit 130 may also be referred to as a scan driver circuit.

The gate driver circuit 130 may include one or more gate driver ICs.

Each of the gate driver ICs may include a shift register, a level register, and the like.

Each of the gate driver ICs may be connected to a bonding pad of the display panel 110 by a TAB method or a COG method, and may be implemented using a gate-in-panel (GIP) structure directly disposed in the display panel 110, or in some cases, may be integrated with the display panel 110. Alternatively, each of the gate driver ICs may be implemented using a COF structure mounted on a film connected to the display panel 110.

The gate driver circuit 130 sequentially supplies the scanning signal having an on or off voltage to the plurality of gate lines GL, under the control of the controller 140.

When a specific gate line is opened by the gate driver circuit 130, the data driver circuit 120 converts the video data Data, received from the controller 140, into an analog data voltage, and supplies the data voltage to the plurality of data lines DL.

The data driver circuit 120 may be disposed on one side of the display panel 110 (e.g., above or below the display panel 110). In some cases, the data driver circuit 120 may be disposed on both sides of the display panel 110 (e.g., above and below the display panel 110), depending on the driving system, the design of the panel, or the like.

The gate driver circuit 130 may be disposed on one side of the display panel 110 (e.g., to the right or left of the display panel 110). In some cases, the gate driver circuit 130 may be disposed on both sides of the display panel 110 (e.g., to the right and left of the display panel 110), depending on the driving system, the design of the panel, or the like.

The display device 100 according to exemplary embodiments may be an organic light-emitting display device, a liquid crystal display (LCD) device, a plasma display device, or the like.

When the display device 100 according to exemplary embodiments is an LCD device, each of the subpixels SP of the display panel 110 may include a pixel electrode, a transistor for transferring a data voltage to the pixel electrode, and the like, and a common electrode, to which a common voltage is applied to generate an electric field together with a pixel voltage (or data voltage) on the pixel electrode of each subpixel SP, may be disposed in the display panel 110.

When the display device 100 according to exemplary embodiments is an organic light-emitting display device, each of the subpixels SP arrayed in the display panel 110 may include an organic light-emitting diode (OLED), e.g., a light-emitting element, and a driving transistor, e.g., a circuit element for driving the OLED.

The type and number of circuit elements of each subpixel SP may be variously determined, depending on the function provided, the design, or the like.

Hereinafter, the display device 100 according to exemplary embodiments will be regarded as an organic light-emitting display device by way of example, for the sake of brevity.

Figure 2:
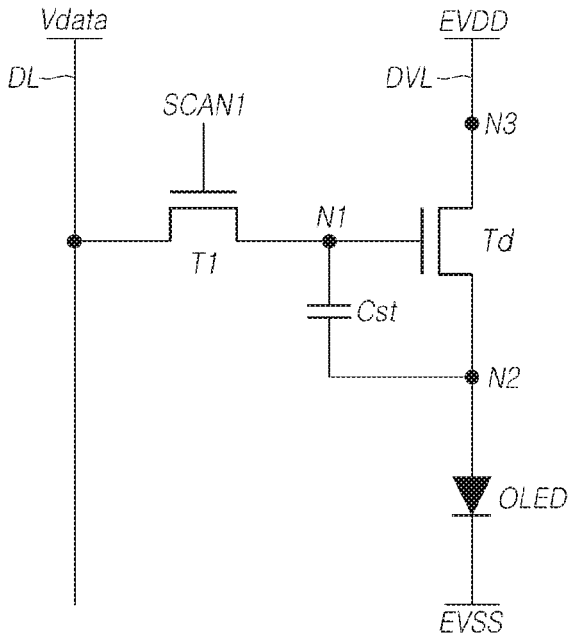
FIG. 2 illustrates a subpixel of the display panel according to exemplary embodiments.
Figure 3:
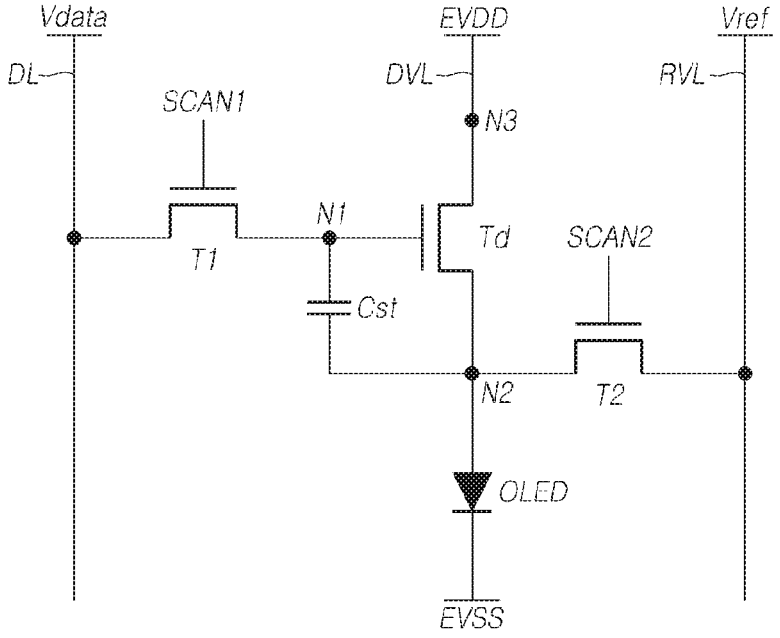
FIG. 3 illustrates another subpixel of the display panel according to exemplary embodiments.

FIG. 2 illustrates a subpixel SP of the display panel 110 according to exemplary embodiments, while FIG. 3 illustrates another subpixel SP of the display panel 110 according to exemplary embodiments.

Referring to FIG. 2, in the display device 100 according to exemplary embodiments, each of the subpixels SP may include an organic light-emitting diode OLED, a driving transistor Td driving the organic light-emitting diode OLED, a first transistor electrically connected between a first node N1 of the driving transistor Td and a corresponding data line DL, a storage capacitor Cst electrically connected to the first node N1 and a second node N2 of the driving transistor Td, and the like.

The organic light-emitting diode OLED may include a first electrode (e.g., an anode or a cathode), an organic light-emitting layer, a second electrode (e.g., a cathode or an anode), and the like.

The first electrode of the organic light-emitting diode OLED may be electrically connected to the second node N2 of the driving transistor Td. A base voltage EVSS may be applied to the second electrode of the organic light-emitting diode OLED. Herein, the base voltage EVSS may be, for example, a ground voltage or a voltage similar to the ground voltage.

The driving transistor Td drives the organic light-emitting diode OLED by supplying driving current to the organic light-emitting diode OLED.

The driving transistor Td may include the first node N1, the second node N2, a third node N3, and the like.

The first node N1 of the driving transistor Td may correspond to a gate node, and may be electrically connected to a source node or a drain node of a first transistor T1. The second node N2 of the driving transistor Td may be electrically connected to the first electrode of the organic light-emitting diode OLED, and may be a source node or a drain node. The third node N3 of the driving transistor Td may be a node, to which a driving voltage EVDD is applied, may be electrically connected to a driving voltage line DVL, through which the driving voltage EVDD is supplied, and may be a drain node or a source node. Hereinafter, the second node N2 and the third node N3 of the driving transistor Td will be regarded as being a source node and a drain node, respectively, by way of example, for the sake of brevity.

The drain node or the source node of the first transistor T1 may be electrically connected to a corresponding data line DL. The source node or the drain node of the first transistor T1 may be electrically connected to the first node N1 of the driving transistor Td. The gate node of the first transistor T1 may be electrically connected to a corresponding gate line, through which a first scanning signal SCAN1 is applied thereto.

The first transistor T1 may be on-off controlled by the first scanning signal SCAN1 applied to the gate node thereof through the corresponding gate line.

The first transistor T1 may be turned on by the first scanning signal SCAN1 to transfer the data voltage Vdata, supplied from the corresponding data line DL, to the first node N1 of the driving transistor Td.

The storage capacitor Cst may be electrically connected between the first node N1 and the second node N2 of the driving transistor Td to maintain the data voltage Vdata corresponding to a video signal voltage or a voltage corresponding to the data voltage Vdata during one frame time.

As described above, the subpixel SP illustrated in FIG. 2 may have a two transistors and one capacitor (2T1C) structure comprised of the two transistors Td and T1 and the single storage capacitor Cst in order to drive the light-emitting diode OLED.

The subpixel structure (2T1C structure) illustrated in FIG. 2 is provided for illustrative purposes only, and the present disclosure is not limited thereto. Rather, a single subpixel SP may further include one or more transistors or one or more capacitors, depending on the function, panel structure, design, and the like.

As an example thereof, as illustrated in FIG. 3, a single subpixel SP may have a 3T1C structure further including a second transistor T2 electrically connected between the second node N2 of the driving transistor Td and a reference voltage line RVL.

Referring to FIG. 3, the second transistor T2 may be electrically connected between the second node of the driving transistor Td and the reference voltage line RVL. The second transistor T2 may be on-off controlled by a second scanning signal SCAN2 applied to a gate node thereof.

More specifically, a drain node or a source node of the second transistor T2 may be electrically connected to the reference voltage line RVL, while the source node or the drain node of the second transistor T2 may be electrically connected to the second node N2 of the driving transistor Td. The gate node of the second transistor T2 may be electrically connected to a corresponding gate line, through which the second scanning signal SCAN2 is applied thereto.

For example, the second transistor T2 may be turned on in a period during display driving, and may be turned off in a period during sensing driving in which characteristics of the driving transistor Td or characteristics of the organic light-emitting diode OLED are sensed.

The second transistor T2 may be turned on by the second scanning signal SCAN2 at a corresponding driving time (e.g., a display driving time or a voltage initialization time of the second node N2 of the driving transistor Td in the period during sensing driving) to transfer the reference voltage Vref, supplied to the reference voltage line RVL, to the second node N2 of the driving transistor Td.

In addition, the second transistor T2 may be turned on by the second scanning signal SCAN2 at a corresponding driving time (e.g., a sampling time in the period during sensing driving) to transfer a voltage of the second node N2 of the driving transistor Td to the reference voltage line RVL.

In other words, the second transistor T2 may control the voltage state of the second node N2 of the driving transistor Td or transfer the voltage of the second node N2 of the driving transistor Td to the reference voltage line RVL.

Here, the reference voltage line RVL may be electrically connected to the analog-to-digital converter sensing and converting the voltage of the reference voltage line RVL to a digital value and outputting sensing data including the digital value.

The analog-to-digital converter may be included in the source driver ICs SDIC of the data driver circuit 120.

The sensing data, output from the analog-to-digital converter, may be used to sense characteristics (e.g., a threshold voltage or mobility) of the driving transistor Td or characteristics (e.g., a threshold voltage) of the organic light-emitting diode OLED.

In addition, the storage capacitor Cst may be an external capacitor intentionally designed to be disposed externally of the driving transistor Td, rather than a parasitic capacitor (e.g., Cgs or Cgd), e.g., an internal capacitor present between the first node N1 and the second node N2 of the driving transistor Td.

Each of the driving transistor Td, the first transistor T1, and the second transistor T2 may be an n-type transistor or a p-type transistor.

In addition, the first scanning signal SCAN1 and the second scanning signal SCAN2 may be separate gate signals. In this case, the first scanning signal SCAN1 and the second scanning signal SCAN2 may be applied to the gate node of the first transistor T1 and the gate node of the second transistor T2 through different gate lines, respectively.

In some cases, the first scanning signal SCAN1 and the second scanning signal SCAN2 may be the same gate signal. In this case, the first scanning signal SCAN1 and the second scanning signal SCAN2 may be commonly applied to the gate node of the first transistor T1 and the gate node of the second transistor T2 through the same gate line.

The subpixel structures illustrated in FIGS. 2 and 3 are presented for illustrative purposes only, and in some cases, one or more transistors or one or more capacitors may further be included. Alternatively, the plurality of subpixels may have the same structure, or some subpixels among the plurality of subpixels may have a different structure from the remaining subpixels.

Hereinafter, a case in which each of the subpixels SP disposed in the display panel 110 is designed in the 3T1C structure illustrated in FIG. 3 will be taken by way of example, for the sake of brevity.

Hereinafter, the driving operation of each of the subpixels SP will be described in brief by way of example.

The driving operation of each of the subpixels SP may include a video data writing step, a boosting step, and a light emission step.

In the video data writing step, a corresponding video data voltage Vdata may be applied to the first node N1 of the driving transistor Td, and the reference voltage Vref may be applied to the second node N2 of the driving transistor Td. Here, a voltage Vref+ΔV similar to the reference voltage Vref may be applied to the second node N2 of the driving transistor Td, due to resistance components between the second node N2 of the driving transistor Td and the reference voltage line RVL.

In this regard, the first transistor T1 and the second transistor T2 may be turned on at the same time or with a slight time difference due to turn-on voltage levels of the first scanning signal SCAN1 and the second scanning signal SCAN2.

In the video data writing step, the storage capacitor Cst may be charged with an electric charge corresponding to a potential difference between both ends Vdata−Vref or Vdata−(Vref+ΔV).

Application of the video data voltage Vdata to the first node N1 of the driving transistor Td is referred to as video data writing.

In the boosting step subsequent to the video data writing step, the first node N1 and the second node N2 of the driving transistor Td may be electrically floated at the same time or with a slight time difference.

In this regard, the first transistor T1 may be turned off by the turn-off voltage level of the first scanning signal SCAN1. In addition, the second transistor T2 may be turned off by the turn-off voltage level of the second scanning signal SCAN2.

In the boosting step, the voltage of the first node N1 and the voltage of the second node N2 of the driving transistor Td may be boosted while the voltage difference between the first node N1 and the second node N2 of the driving transistor Td is maintained.

When the voltage of the second node N2 of the driving transistor Td arrives at a certain voltage or higher through the boosting of the voltages of the first node N1 and the second node N2 of the driving transistor Td during the boosting step, the operation enters the light emission step.

In this light emission step, driving current flows to the organic light-emitting diode OLED. Then, the organic light-emitting diode OLED can emit light.

Figure 4:
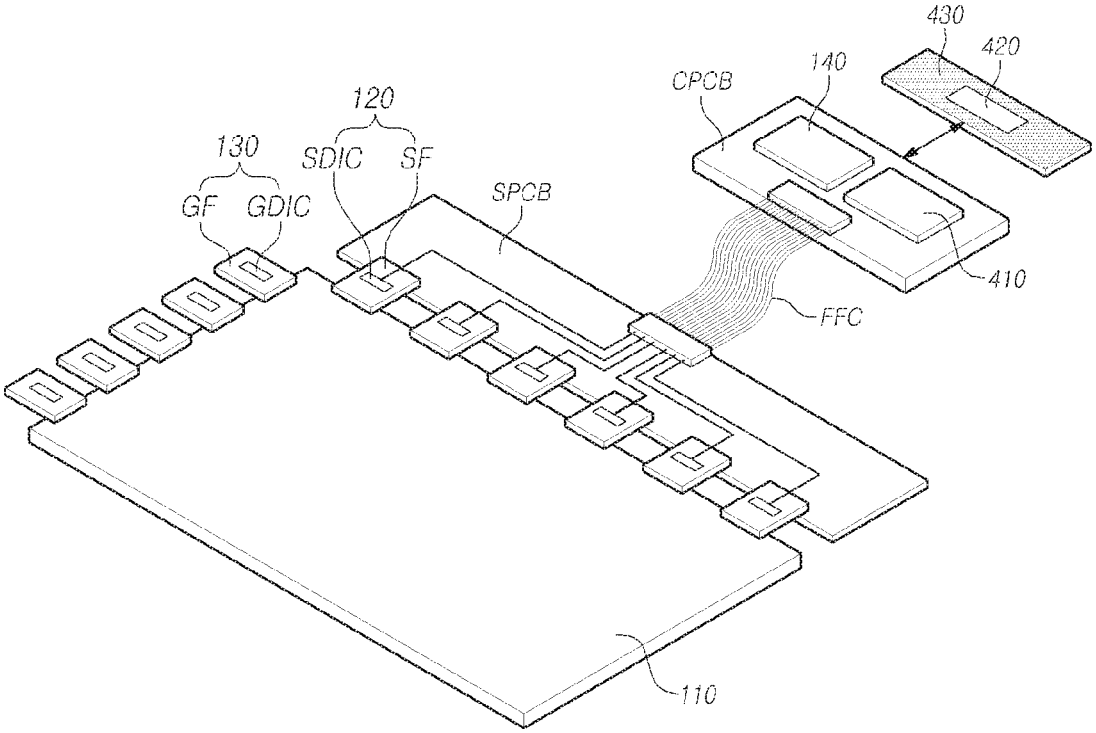
FIG. 4 illustrates a system configuration of the display device according to exemplary embodiments.

FIG. 4 illustrates a system configuration of the display device 100 according to exemplary embodiments.

Referring to FIG. 4, each of the gate driver ICs GDIC may be mounted on a film GF connected to the display panel 110 when the gate driver ICs GDIC are implemented using a COF structure.

Each of the source driver ICs SDIC may be mounted on a film SF connected to the display panel 110 when the source driver ICs SDIC are implemented using a COF structure.

The display device 100 may include at least one source printed circuit board SPCB and a control printed circuit board CPCB, on which control components and a variety of electric devices are mounted, in order to provide circuit connection of the plurality of source driver ICs SDIC to the other devices.

The films SF, on which the source driver ICs SDIC are mounted, may be connected to the at least one source printed circuit board SPCB. That is, one portion of each of the films SF, on which the source driver ICs SDIC are mounted, may be electrically connected to the display panel 110, and the other portion of each of the films SF may be electrically connected to the source printed circuit board SPCB.

The controller 140, a power management IC (PMIC) 410, and the like, may be mounted on the control printed circuit board CPCB. The controller 140 controls the operation of the data driver circuit 120, the gate driver circuit 130, and the like. The power management IC 410 supplies various forms of voltage or current to the display panel 110, the data driver circuit 120, the gate driver circuit 130, and the like, or controls various forms of voltage or current to be supplied to the same.

A circuit connection between the at least one source printed circuit board SPCB and the control printed circuit board CPCB may be enabled by at least one connecting member. Here, the connecting member may be, for example, a flexible printed circuit (FPC), a flexible flat cable (FFC), or the like.

The at least one source printed circuit board SPCB and the control printed circuit board CPCB may be combined (or integrated) into a single printed circuit board.

The display device 100 may further include a set board 430 electrically connected to the control printed circuit board CPCB. The set board 430 may also be referred to as a power board.

A main power management circuit (M-PMC) 420 performing overall power management of the display device 100 may be present on the set board 430.

The power management IC 410 is a circuit managing the power of a display module including the display panel 110 and the driving circuits 120, 130, and 140 of the display panel 110. The main power management circuit 420 is a circuit managing the power of the entire system, including the display module. The main power management circuit 420 may work in concert with the power management IC 410.

Figure 5:
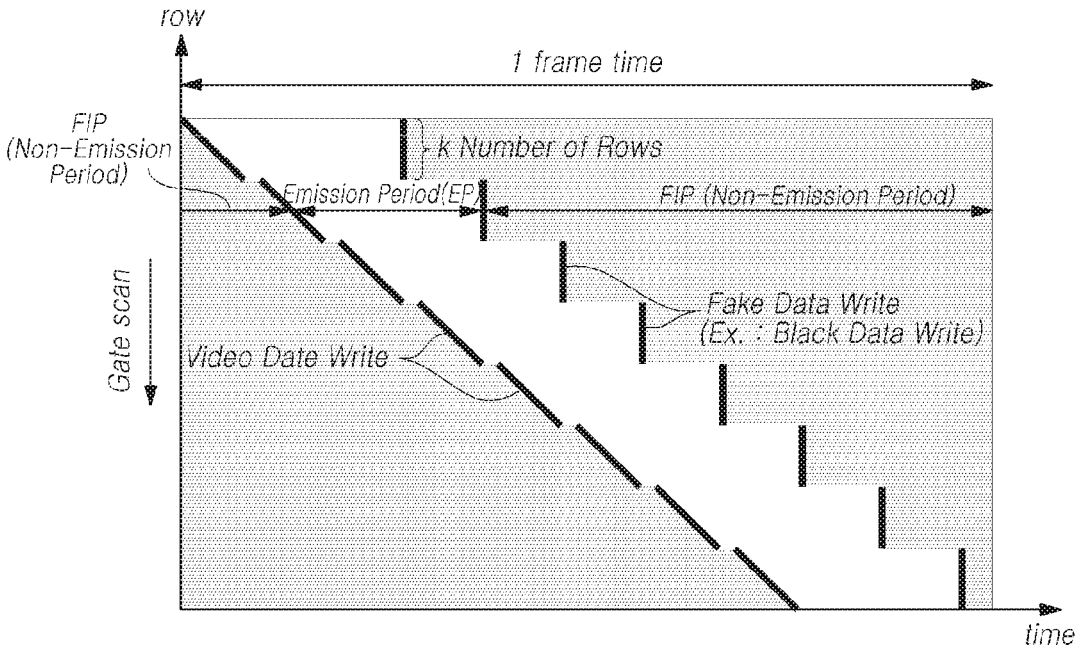
FIG. 5 is a diagram illustrating 2H overlap driving and fake data insertion driving in the display device according to exemplary embodiments.
Figure 6:
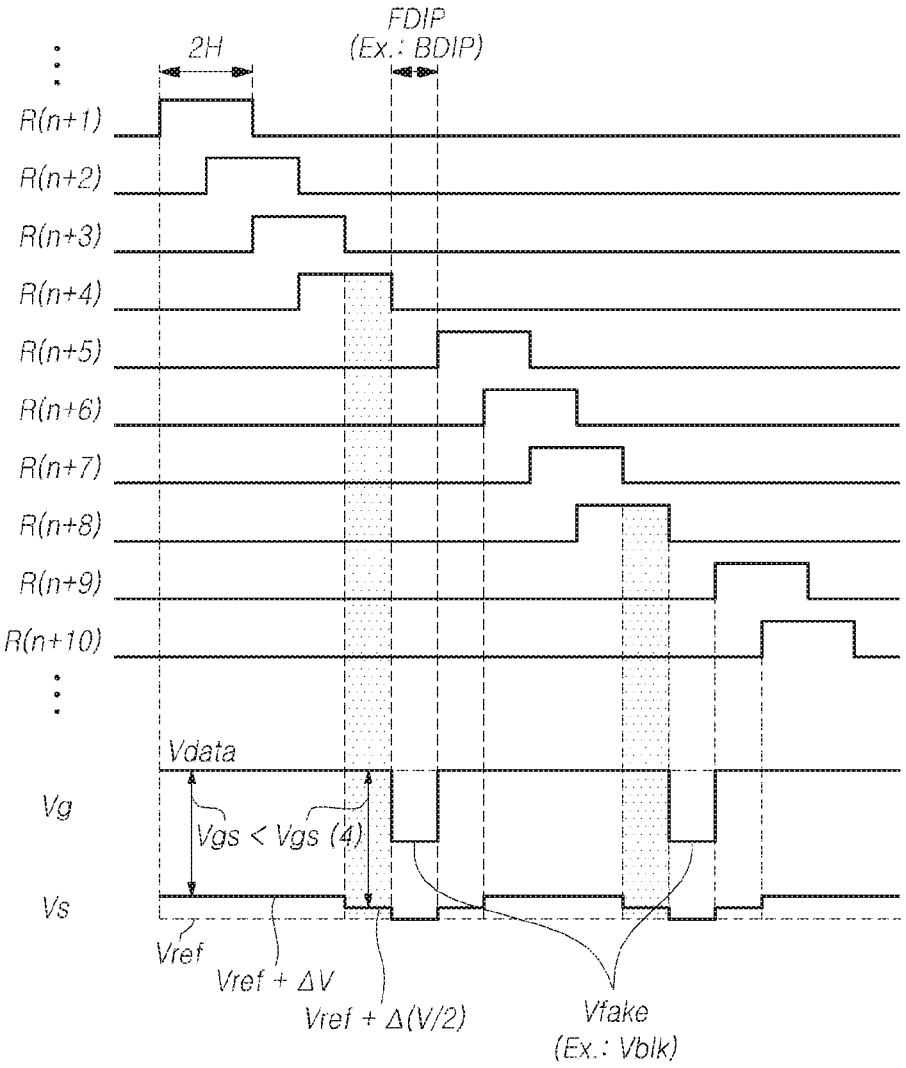
FIG. 6 illustrates the driving timing of the 2H overlap driving and the fake data insertion driving of the display device according to exemplary embodiments.
Figure 7:
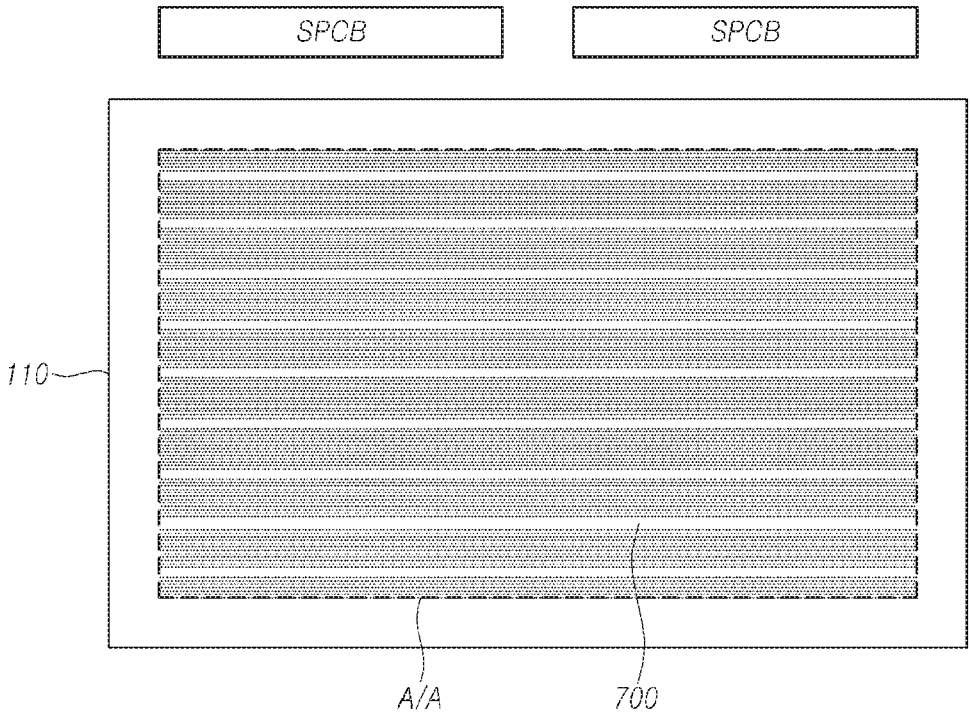
FIG. 7 illustrates a screen image due to the 2H overlap driving and the fake data insertion driving of the display device according to exemplary embodiments.

FIG. 5 is a diagram illustrating 2H overlap driving and fake data insertion (FDI) driving in the display device 100 according to exemplary embodiments, FIG. 6 illustrates the driving timing of the 2H overlap driving and the fake data insertion driving in the display device 100 according to exemplary embodiments, and FIG. 7 illustrates a screen image due to the 2H overlap driving and the fake data insertion driving in the display device 100 according to exemplary embodiments.

In the display panel 110 according to exemplary embodiments, the plurality of subpixels SP may be arrayed in the form of a matrix.

A plurality of subpixel rows . . . , R(n+1), R(n+2), R(n+3), R(n+4), R(n+5), and . . . may be present in the display panel 110. The plurality of subpixel rows . . . , R(n+1), R(n+2), R(n+3), R(n+4), R(n+5), and . . . may be gate-driven sequentially.

When each subpixel of the subpixels SP has a 3T1C structure, one or two gate lines GL, through which the first scanning signal SCAN1 and the second scanning signal SCAN2 are transferred, may be disposed in each of the plurality of subpixel rows . . . , R(n+1), R(n+2), R(n+3), R(n+4), R(n+5), and . . . .

In addition, a plurality of subpixel columns may be present in the display panel 110. One data line DL may be disposed in each of the plurality of subpixel columns, in a corresponding manner.

As in the above-described subpixel driving operation, when the (n+1)th subpixel row R(n+1), among the plurality of subpixel rows . . . , R(n+1), R(n+2), R(n+3), R(n+4), R(n+5), and . . . , the first scanning signal SCAN1 and the second scanning signal SCAN2 are applied to the subpixels SP, among the plurality of subpixels SP, arrayed in the (n+1)th subpixel row R(n+1), and a video data voltage Vdata is applied to the subpixels SP, arrayed in the (n+1)th subpixel row R(n+1), through the plurality of data lines DL.

Afterwards, the (n+2)th subpixel row R(n+2), located below the (n+1)th subpixel row R(n+1), is driven. The first scanning signal SCAN1 and the second scanning signal SCAN2 are applied to the subpixels SP, among the plurality of subpixels SP, arrayed in the (n+2)th subpixel row R(n+2), and the video data voltage Vdata is applied to the subpixels SP, arrayed in the (n+2)th subpixel row R(n+2), through the plurality of data lines DL.

In this manner, video data is written sequentially in the plurality of subpixel rows . . . , R(n+1), R(n+2), R(n+3), R(n+4), R(n+5), and . . . . Here, the video data writing is the procedure performed in the video data writing step of the subpixel driving operation as described above.

The video data writing step, the boosting step, and the light emission step may be sequentially performed on the plurality of subpixel rows . . . , R(n+1), R(n+2), R(n+3), R(n+4), R(n+5), and . . . during one frame time, in response to the above-described subpixel driving operation.

Returning to FIG. 5, in the plurality of subpixel rows . . . , R(n+1), R(n+2), R(n+3), R(n+4), R(n+5), and . . . , an emission period EP does not continue through the entirety of one frame time, due to the light emission step of the subpixel driving operation. Here, the emission period EP may also be referred to as a real image period.

Instead, each of the plurality of subpixel rows . . . , R(n+1), R(n+2), R(n+3), R(n+4), R(n+5), and . . . may be subjected to real display driving and fake data insertion (FDI) driving during the single frame time.

During one frame time, a single subpixel SP emits light during the emission period EP by passing through the video data writing step, the boosting step, and the light emission step while the real display driving is being carried out. Subsequently, fake display driving is started.

The fake display driving is fake driving, different from the real display driving for displaying real images.

The fake display driving may be performed by inserting fake images between real images. Thus, the fake display driving is also referred to as the fake data insertion driving.

In the real display driving, the video data voltage Vdata corresponding to real images is supplied to the subpixels SP in order to display real images. In contrast, in the fake data insertion driving, a fake data voltage Vfake corresponding to a fake image, unrelated to real images, is supplied to the subpixels SP.

That is, while the video data voltage Vdata, supplied to the subpixels SP during the real display driving, may vary depending on the frame or the image, the fake data voltage Vfake, supplied to the subpixels SP during the fake data insertion driving, may be constant without varying depending on the frame or the image.

According to a method of the fake data insertion driving, a single subpixel row may be subjected to the fake data insertion driving, and then a next single subpixel row may be subjected to the fake data insertion driving.

In addition, according to another method of the fake data insertion driving, a plurality of subpixel rows may be simultaneously subjected to the fake data insertion driving, and then a plurality of next subpixel rows may be simultaneously subjected to the fake data insertion driving. That is, the fake data insertion driving may be performed simultaneously on each of the plurality of subpixel rows.

The number k of the subpixels simultaneously subjected to the fake data insertion driving may be 2, 4, 8, or the like.

Referring to FIGS. 5 and 6, after the video data writing is performed sequentially on the subpixel rows R(n+1), R(n+2), R(n+3), and R(n+4), the fake data voltage Vfake may be supplied simultaneously to subpixel rows, disposed ahead of the subpixel row R(n+1), and the emission periods EP of which have already passed.

Subsequently, after the video data writing is performed sequentially on the subpixel rows R(n+5), R(n+6), R(n+7), and R(n+8), the fake data voltage Vfake may be supplied simultaneously to a plurality of subpixel rows, disposed ahead of the subpixel row R(n+5), and a length of emission period EP of which has passed already.

Here, a period in which the fake data insertion driving is performed is referred to as a fake data insertion period (FDIP), while a period in which the fake image is displayed by the fake data insertion driving is referred to as a fake image period (FIP).

In addition, the number k of subpixel rows, on which the fake data insertion driving is performed simultaneously, may be the same or different. In an example, two subpixel rows may be simultaneously subjected to the fake data insertion driving, and then four subpixel rows may be simultaneously subjected to the fake data insertion driving. In another example, four subpixel rows may be simultaneously subjected to the fake data insertion driving, and then eight subpixel rows may be simultaneously subjected to the fake data insertion driving.

Since both the real data and the fake data are displayed in the same frame due to the above-described fake data insertion driving, motion blurring, in which an image is blurred instead of being clearly distinguishable, can be prevented, thereby improving image quality.

In the fake data insertion driving as described above, the video data writing and the fake data writing may be performed through the data lines DL.

In addition, since the fake data writing may be performed simultaneously on the plurality of lines (e.g., subpixel rows) as described above, luminance differences due to different lengths of the emission period EP depending on line position can be compensate for, so that a video data writing time can be obtained.

In addition, the lengths of the emission period EP depending on the image may be adaptively adjusted by adjusting the timing of the fake data insertion driving.

The video data writing timing and the fake data writing timing may be varied by controlling the gate driving.

In addition, in the fake data insertion driving, the fake data voltage Vfake, supplied to the subpixels SP, may be, for example, a black data voltage Vblk. For example, the black data voltage Vblk is a data voltage for representing a black image or an image similar to the black image. The black data voltage Vblk may be 0V or a voltage lower or higher than 0V.

In this case, the fake data insertion driving may be referred to as black data insertion (BDI) driving. The fake data writing in the fake data insertion driving may be referred to as black data writing. In addition, the fake data insertion period FDIP may also be referred to as a BDI period BDIP. In addition, the fake image period FIP may also be referred to as a black image period or a non-emission period.

The gate driving to each of the plurality of subpixel rows . . . , R(n+1), R(n+2), R(n+3), R(n+4), R(n+5), and . . . may be performed sequentially to overlap for predetermined lengths of time.

According to the illustration of FIG. 6, turn-on level periods of scanning signals (e.g., SCAN1 and SCAN2 in the case of the 3T1C structure illustrated in FIG. 3), supplied to the plurality of subpixel rows . . . , R(n+1), R(n+2), R(n+3), R(n+4), R(n+5), and . . . , respectively, are 2H, where H is a horizontal time. In addition, the turn-on level periods of the scanning signals (e.g., SCAN1 and SCAN2 in the case of the 3T1C structure illustrated in FIG. 3), supplied to the plurality of subpixel rows . . . , R(n+1), R(n+2), R(n+3), R(n+4), R(n+5), and . . . , respectively, may overlap with each other.

In other words, all of the turn-on level periods of the scanning signals (e.g., SCAN1 and SCAN2 in the case of the 3T1C structure illustrated in FIG. 3), supplied to the plurality of subpixel rows . . . , R(n+1), R(n+2), R(n+3), R(n+4), R(n+5), and . . . , respectively, may be 2H.

In addition, the turn-on level periods 2H of the first scanning signal SCAN1 and the second scanning signal SCAN2, applied to the first transistor T1 and the second transistor T2 of the subpixels SP arrayed in the subpixel row R(n+1), may overlap the turn-on level periods 2H of the first scanning signal SCAN1 and the second scanning signal SCAN2, applied to the first transistor T1 and the second transistor T2 of the subpixels SP arrayed in the subpixel row R(n+2), by 1H.

The turn-on level periods 2H of the first scanning signal SCAN1 and the second scanning signal SCAN2, applied to the first transistor T1 and the second transistor T2 of the subpixels SP arrayed in the subpixel row R(n+2), may overlap the turn-on level periods 2H of the first scanning signal SCAN1 and the second scanning signal SCAN2, applied to the first transistor T1 and the second transistor T2 of the subpixels SP arrayed in the subpixel row R(n+3), by 1H.

The turn-on level periods 2H of the first scanning signal SCAN1 and the second scanning signal SCAN2, applied to the first transistor T1 and the second transistor T2 of the subpixels SP arrayed in the subpixel row R(n+3), may overlap the turn-on level periods 2H of the first scanning signal SCAN1 and the second scanning signal SCAN2, applied to the first transistor T1 and the second transistor T2 of the subpixels SP arrayed in the subpixel row R(n+4), by 1H.

According to the illustration of FIG. 6, the turn-on level periods of the scanning signals SCAN1 and SCAN2 in the subpixel rows are 2H, and the turn-on level periods of the scanning signals SCAN1 and SCAN2 in two adjacent subpixel rows may overlap by 1H.

This type of gate driving is referred to as overlap driving. When the length of the turn-on level periods of the scanning signals SCAN1 and SCAN2 in each of the subpixel rows is 2H as illustrated in FIG. 6, the gate driving at this time is referred to as 2H overlap driving.

The overlap driving may be modified to have a variety of forms, other than the 2H overlap driving.

In another example of the overlap driving, the turn-on level periods of the scanning signals SCAN1 and SCAN2 in each subpixel row may be 3H, and the turn-on level periods of the scanning signals SCAN1 and SCAN2 in two adjacent subpixel rows may overlap by 2H.

In another example of the overlap driving, the turn-on level periods of the scanning signals SCAN1 and SCAN2 in each subpixel row may be 3H, and the turn-on level periods of the scanning signals SCAN1 and SCAN2 in two adjacent subpixel rows may overlap by 1H.

In another example of the overlap driving, the turn-on level periods of the scanning signals SCAN1 and SCAN2 in each subpixel row may be 4H, and the turn-on level periods of the scanning signals SCAN1 and SCAN2 in two adjacent subpixel rows may overlap by 3H.

Although a variety of overlap driving methods are possible, the 2H overlap driving will mainly be described hereinafter by way of example, for the sake of brevity.

In the 2H overlap driving as described above, the front portion (e.g., a period having a length 1H) of the turn-on level period (e.g., a period having a length 2H) of the scanning signal SCAN1/SCAN2 in each subpixel row is a scanning signal portion for pre-charge (PC) driving in which the data voltage (e.g., pre-charge data voltage) is applied to the corresponding subpixels. The rear portion (e.g., a period having a length 1H) of the turn-on level period (e.g., a period having a length 2H) of the scanning signal SCAN1/SCAN2 in each subpixel row is a scanning signal portion, by which the video data writing is performed to apply the real video data voltage Vdata to the corresponding subpixel.

The overlap driving as described above can improve the state of charge in each subpixel, thereby improving image quality.

When the fake data insertion driving and the 2H overlap driving are performed simultaneously, the turn-on level periods of the first and second scanning signals SCAN1 and SCAN2 in the subpixel row R(n+3) overlap the turn-on level periods of the first and second scanning signals SCAN1 and SCAN2 in the subpixel row R(n+4).

Here, the rear portion (1H period) of the turn-on level period (2H period) of the first and second scanning signals SCAN1 and SCAN2 in the subpixel row R(n+3) is a period overlapping the front portion (1H period, corresponding to the pre-charge driving period) of the turn-on level period (2H period) of the first and second scanning signals SCAN1 and SCAN2 in the next subpixel row R(n+4). The rear portion is a period in which the video data writing is performed on the subpixel row R(n+3). The front portion (1H period) of the turn-on level period (2H period) of the first and second scanning signals SCAN1 and SCAN2 in the subpixel row R(n+4) is a pre-charge driving period. In addition, the subpixel row R(n+3) and the subpixel row R(n+4) are subpixel rows in which the video data writing is performed before the fake data insertion driving proceeds.

In addition, the turn-on level period of the first and second scan signals SCAN1 and SCAN2 in the subpixel row R(n+5) overlaps the turn-on level period of the first and second scan signals SCAN1 and SCAN2 in the subpixel row R(n+6).

Here, the rear portion (1H period) of the turn-on level period of the first and second scanning signals SCAN1 and SCAN2 in the subpixel row R(n+5) is a period overlapping the front portion (1H period, corresponding to the pre-charge driving period) of the turn-on level period of the first and second scanning signals SCAN1 and SCAN2 in the subpixel row R(n+6). The rear portion is a period in which the video data writing is performed on the subpixel row R(n+3). In addition, the subpixel row R(n+5) and the subpixel row R(n+6) are subpixel rows in which the video data writing is performed before the fake data insertion driving proceeds.

However, the rear portion (1H period) of the turn-on level period of the first and second scanning signals SCAN1 and SCAN2 in the subpixel row R(n+4) does not overlap the front portion of the turn-on level period of the first and second scanning signals SCAN1 and SCAN2 in the next subpixel row R(n+5).

The rear portion (1H period) of the turn-on level period of the first and second scanning signals SCAN1 and SCAN2 in the subpixel row R(n+4) is a period in which the video data writing is performed on the subpixel row R(n+4).

Since the rear portion (1H period) of the turn-on level period of the first and second scanning signals SCAN1 and SCAN2 in the subpixel row R(n+4) does not overlap the front portion of the turn-on level period of the first and second scanning signals SCAN1 and SCAN2 in the next subpixel row R(n+5), pre-charge driving is not performed on the next subpixel row R(n+5) during the rear portion (1H period) of the turn-on level period of the first and second scanning signals SCAN1 and SCAN2 in the subpixel row R(n+4).

Here, on the basis of the fake data insertion period FDIP, the subpixel row R(n+4) is a subpixel row in which the video data writing is performed, directly before the fake data insertion driving, and the subpixel row R(n+5) is a subpixel row in which the video data writing is performed, directly after the fake data insertion driving.

The turn-on level period of the first and second scanning signals SCAN1 and SCAN2 in the subpixel row R(n+4) and the turn-on level period of the first and second scanning signals SCAN1 and SCAN2 in the next subpixel row R(n+5) are separated by a period corresponding to the fake data insertion period FDIP.

In FIG. 6, graph Vg illustrates all voltages of the first nodes N1 of the driving transistors Td in the subpixels included in the subpixel rows, representing changes in the voltage state before entering the boosting step in the subpixel driving operation. Graph Vs illustrates all voltages of the second nodes N2 of the driving transistors Td in the subpixels included in the subpixel rows, representing changes in the voltage state before entering the boosting step in the subpixel driving operation.

Referring to graph Vg in FIG. 6, in the remaining period except for the fake data insertion period FDIP, a voltage Vg of the first node N1 of the driving transistor Td in each subpixel of each subpixel row is converted into a video data voltage Vdata, in response to the process of the video data writing.

However, during the fake data insertion period FDIP, the voltage Vg of the first node N1 of the driving transistor Td in each of the subpixels in the subpixel rows, subjected to the fake data insertion driving, becomes the fake data voltage Vfake.

In addition, as described above, the rear portion of the turn-on level period of the first and second scanning signals SCAN1 and SCAN2 in each of the subpixel rows R(n+1), R(n+2), and R(n+3) overlaps the front portion of the turn-on level period of the first and second scanning signals SCAN1 and SCAN2 in the next subpixel row.

Thus, during the turn-on level period of the first and second scanning signals SCAN1 and SCAN2 in each of the subpixel rows R(n+1), R(n+2), and R(n+3), a voltage Vs of the second node N2 of the driving transistor Td of each of the subpixels included in the subpixel rows R(n+1), R(n+2), and R(n+3) are a voltage Vref+ΔV similar to the reference voltage Vref in the video data writing step. Here, the potential difference Vgs between the first node N1 and the second node N2 of each driving transistor Td is Vdata−(Vref+ΔV).

However, the rear portion of the turn-on level period of the first and second scanning signals SCAN1 and SCAN2 in the subpixel row R(n+4) does not overlap the front portion of the turn-on level period of the first and second scanning signals SCAN1 and SCAN2 in the next subpixel row R(n+5).

Accordingly, during 1H period directly before the fake data insertion period FDIP, e.g., the rear portion of the turn-on level period of the first and second scanning signals SCAN1 and SCAN2 in the subpixel row R(n+4) (that does not overlap the front portion of the turn-on level period of the first and second scanning signals SCAN1 and SCAN2 in the next subpixel row R(n+5), the voltage Vs of the second node N2 of the driving transistor Td of each subpixel included in the subpixel row R(n+4) may be Vref+Δ(V/2) lower than Vref+ΔV. Thus, the potential difference Vgs (Vgs(4)) between the first node N1 and the second node N2 of each driving transistor Td included in the subpixel row R(n+4) is Vdata−(Vref+Δ(V/2), increased from that of the previous period. Such an increase in Vgs will be described in more detail with reference to FIG. 12.

Since the potential difference Vgs (Vgs(4)) between the first node N1 and the second node N2 of the driving transistor Td in each of the subpixel rows R(n+4) and R(n+8), on which the video data writing is performed, directly before the fake data insertion period FDIP, increases as described above, bright stripes 700 may periodically appear in the subpixel rows R(n+4) and R(n+8), on which the video data writing is performed, directly before the fake data insertion period FDIP, as described above.

Accordingly, the following description will be provided of a configuration and a driving method able to prevent the periodic appearance of the bright stripes 700 in an active area, e.g., a display area, of the display panel 110 during the fake data insertion driving.

Figure 8:
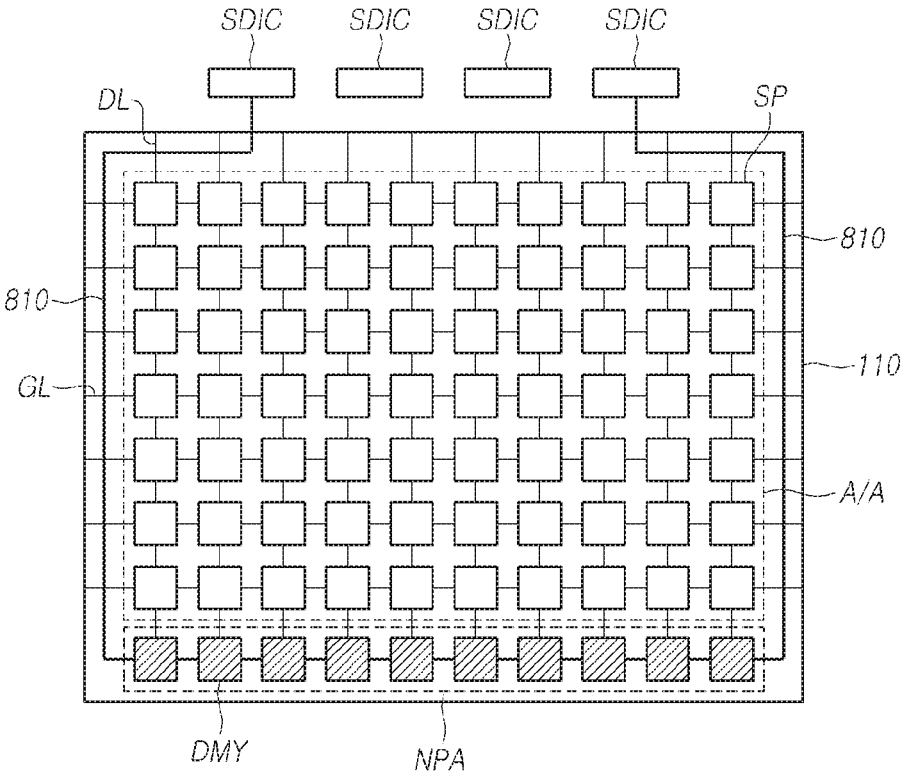
FIG. 8 illustrates dummy subpixels disposed in the display panel according to exemplary embodiments.
Figure 9:
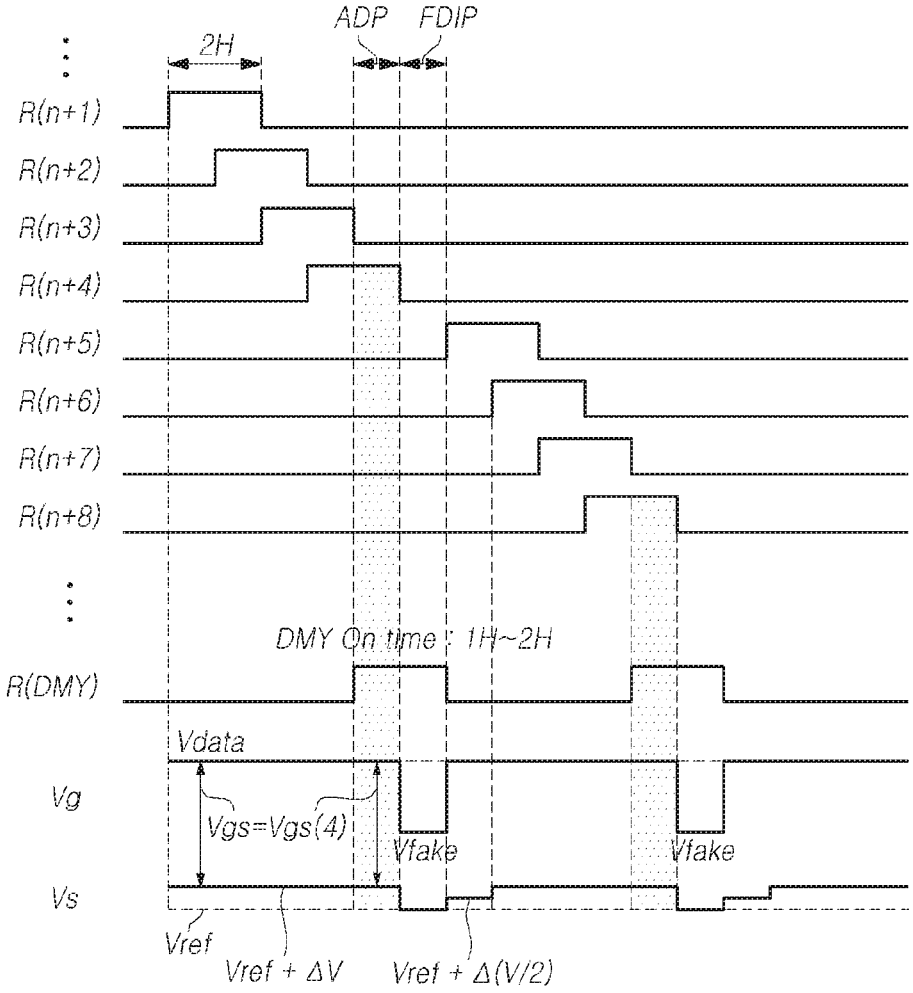
FIG. 9 illustrates the driving timing of the 2H overlap driving and the fake data insertion driving using the driving of the dummy subpixels in the display device according to exemplary embodiments.
Figure 10:
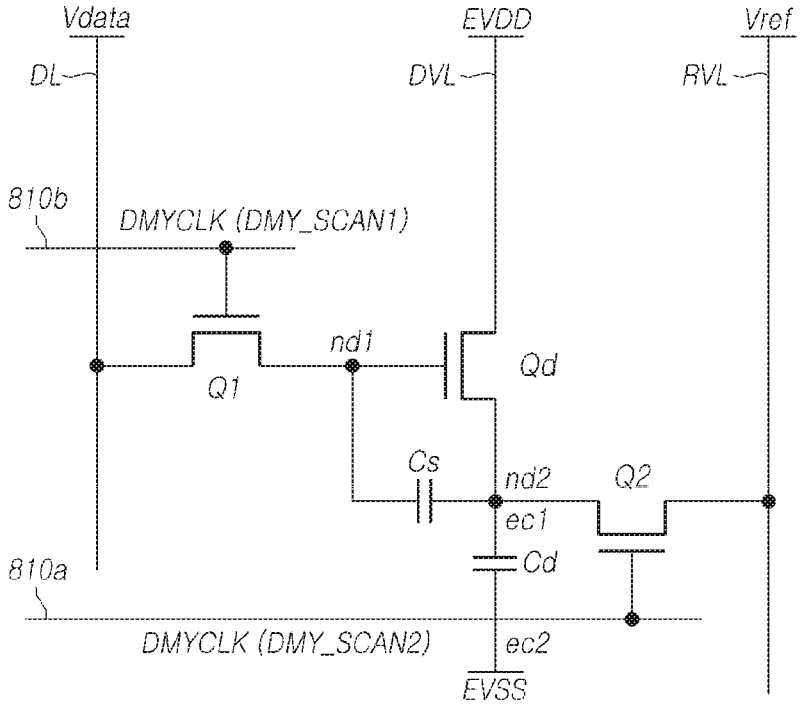
FIG. 10 illustrates a dummy subpixel disposed in the display panel according to exemplary embodiments.

FIG. 8 illustrates dummy subpixels DMY disposed in the display panel 110 according to exemplary embodiments, FIG. 9 illustrates the driving timing of the 2H overlap driving and the fake data insertion driving using the driving of the dummy subpixels DMY in the display device 100 according to exemplary embodiments, and FIG. 10 illustrates a dummy subpixel DMY disposed in the display panel 110 according to exemplary embodiments.

Referring to FIG. 8, in order to remove or reduce the appearance of the bright stripes 700 in the subpixel row, on which video data writing is performed, directly before the process of the fake data insertion driving, in the cycle of the fake data insertion driving, one or more dummy subpixels DMY are disposed in each subpixel column in a specific area NPA of the display panel 110, and while the subpixel row is being driven for the video data writing directly before the fake data insertion (FDI), the dummy subpixels DMY are simultaneously driven.

Referring to FIG. 9, the rear portion of the turn-on level period of the first and second scanning signals SCAN1 and SCAN2 in the subpixel row R(n+4), on which the video data writing is performed, directly before the fake data insertion period FDIP, does not overlap the front portion of the turn-on level period of the first and second scanning signals SCAN1 and SCAN2 in the next subpixel row R(n+5).

To compensate for such non-overlap, the dummy subpixels DMY in a dummy subpixel row R(DMY) are simultaneously driven during the rear portion of the turn-on level period of the first and second scanning signals SCAN1 and SCAN2 in the subpixel row R(n+4), on which the video data writing is performed, directly before the fake data insertion period FDIP.

The driving of the dummy subpixels DMY is performed as follows.

During the rear period of the turn-on level period of the first and second scanning signals SCAN1 and SCAN2 in the subpixel row R(n+4), on which the video data writing is performed, directly before the fake data insertion period FDIP, the gate driver circuit 130 supplies a dummy clock signal (e.g., a type of scanning signal) having a turn-on level to the dummy subpixels DMY in the dummy subpixel row R(DMY). In addition, the data driver circuit 120 may supply the video data voltage Vdata, the same as those supplied to the subpixel row R(n+4), to the dummy subpixels DMY in the dummy subpixel row R(DMY).

Thus, the subpixel row R(n+4), on which the video data writing is performed, directly before the fake data insertion period FDIP, may have the same driving state as the previous subpixel rows R(n+1), R(n+2), and R(n+3).

Accordingly, the potential difference Vgs(4) between the first node N1 and the second node N2 of each of the driving transistors Td in the subpixel row R(n+4), on which the video data writing is performed, directly before the fake data insertion period FDIP, may be maintained at a value the same as or corresponding to previous Vgs, e.g., Vgs(4)=Vgs, instead of increasing.

Thus, the appearance of the bright stripes 700 in the subpixel row, on which the video data writing is performed, directly before the fake data insertion, may be removed or reduced in the cycle of the fake data insertion driving.

The rear portion of the turn-on level period of the first and second scanning signals SCAN1 and SCAN2 in the subpixel row R(n+4), on which the video data writing is performed, directly before the fake data insertion period FDIP, which does not overlap the turn-on level period of the first and second scanning signals SCAN1 and SCAN2 in the next subpixel row R(n+5), is referred to as an assist driving period ADP in which the dummy subpixel DMY is driven.

Referring to FIG. 8, the dummy subpixels DMY may be disposed in an area in the periphery of the active area A/A. More particularly, the dummy subpixels DMY may be disposed in the periphery of the subpixel, among the plurality of subpixels SP, last driven during one frame time.

In other words, the dummy pixels DMY are disposed in the periphery of the active area A/A of the display panel 110. More particularly, the dummy pixels DMY may be located opposite the portions to which the source driver ICs SDIC are connected.

Referring to FIG. 8, signal lines 810 may be disposed in the display panel 110, such that a dummy clock signal DMYCLK for driving the dummy subpixels DMY is transferred through the signal lines 810.

Referring to FIG. 9, a length of on-time, in which the dummy subpixels DMY disposed in the dummy subpixel row R(DMY) are driven, may be 1H, equal to the assist driving period ADP, or 2H, obtained by adding the assist driving period ADP and the fake data insertion period FDIP.

Referring to FIG. 10, the dummy subpixels DMY may have substantially the same structure as subpixels SP, except that a dummy capacitor Cd may be present in place of an organic light-emitting diode OLED.

Referring to FIG. 10, each of the dummy subpixels DMY may include: the dummy capacitor Cd having a first electrode ec1 and a second electrode ec2; a dummy driving transistor Qd electrically connected between the first electrode ec1 of the dummy capacitor Cd and a driving voltage line DVL; a dummy scanning transistor Q1 controlled by a second dummy scanning signal DMY_SCAN1, e.g., the dummy clock signal DMYCLK, and electrically connected between a first node nd1 of the dummy driving transistor Qd and a corresponding data line DL; a dummy transistor Q2 controlled by a first dummy scanning signal DMY_SCAN2, e.g., the dummy clock signal DMYCLK, and electrically connected between the first electrode ec1 of the dummy capacitor Cd and a first reference voltage line RVL; and a dummy storage capacitor Cs electrically connected between the first node nd1 and a second node nd2 of the dummy driving transistor Qd.

The two dummy clock signals DMYCLK, e.g., the second dummy scanning signal DMY_SCAN1 and the first dummy scanning signal DMY_SCAN2, may be the same or different signals.

The signal line 810*b*, through which the second dummy scanning signal DMY_SCAN1 is transferred, and the signal line 810*a*, through which the first dummy scanning signal DMY_SCAN2 is transferred, may be the same or different signal lines.

Figure 11:
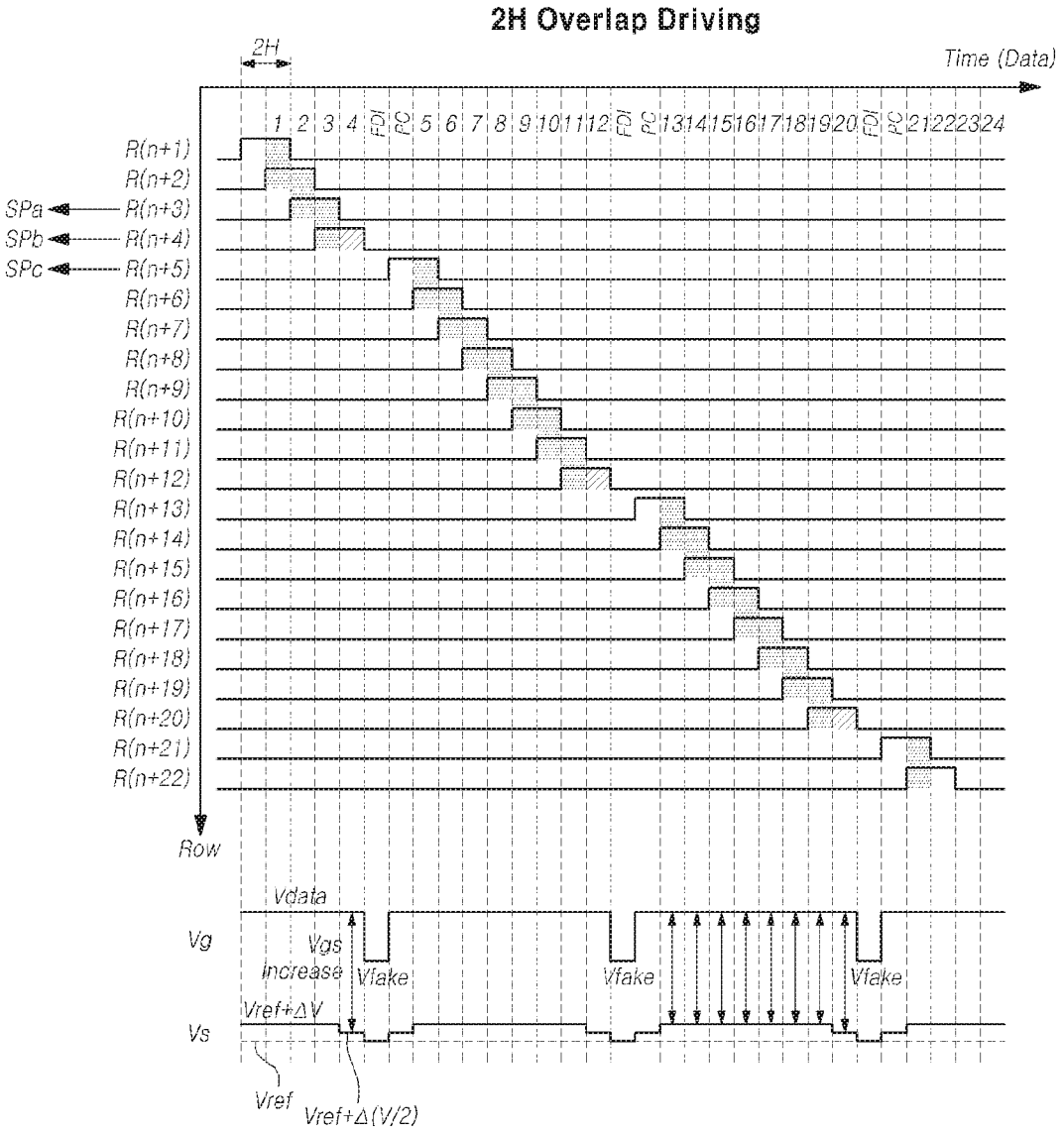
FIGS. 11 to 13 illustrate the 2H overlap driving and the fake data insertion driving without the use of the dummy subpixels in the display device according to exemplary embodiments.
Figure 12:
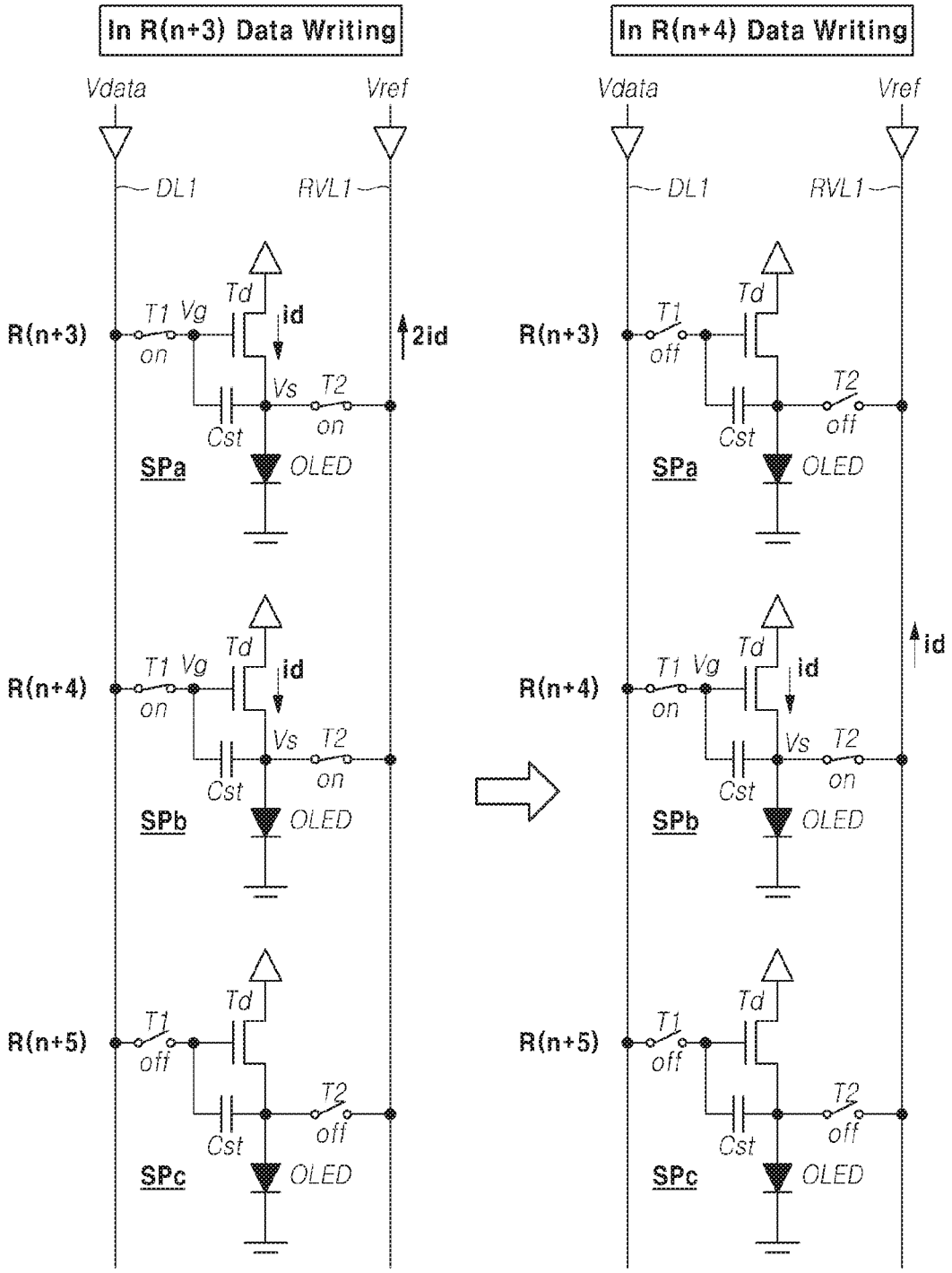
Figure 13:
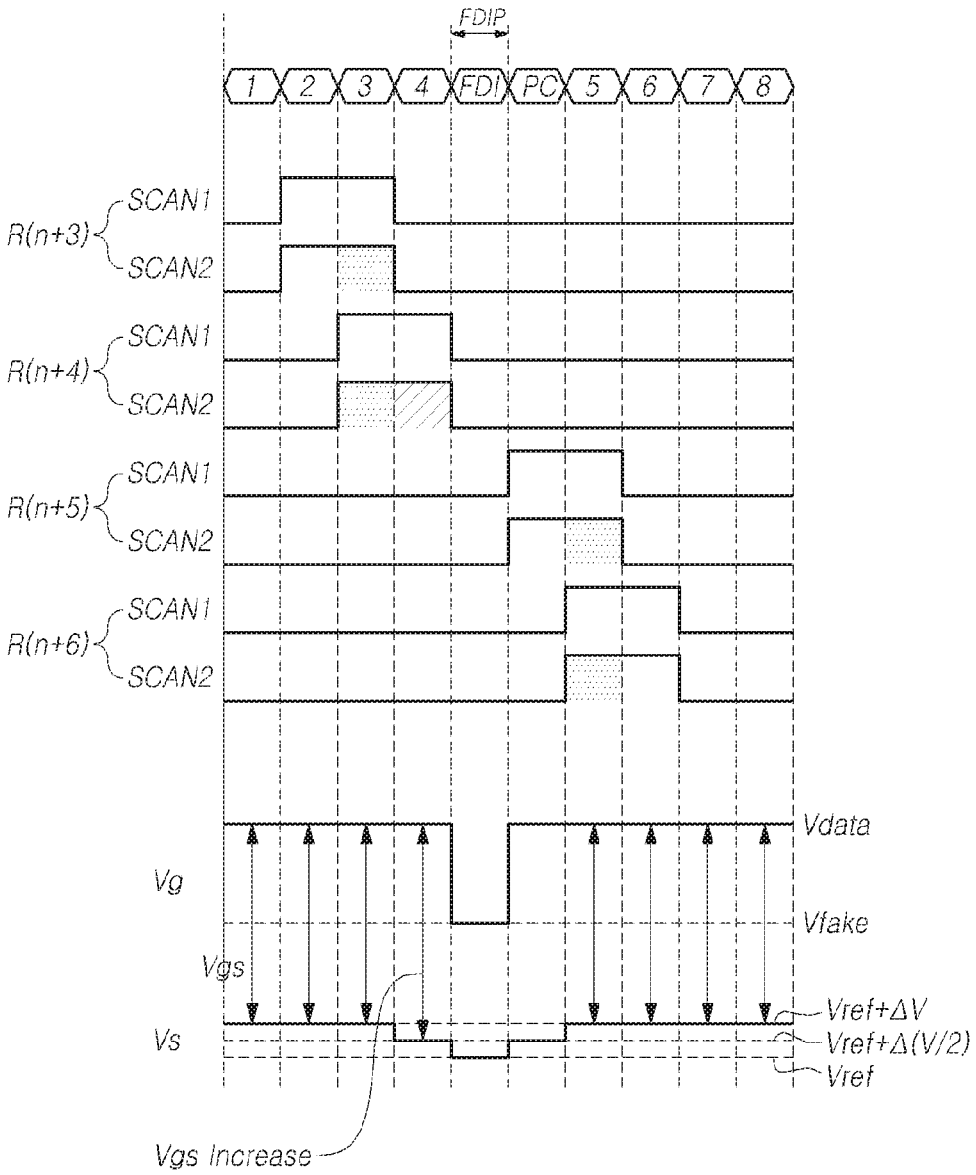

FIGS. 11 to 13 illustrate the 2H overlap driving and the fake data insertion driving without the use of the dummy subpixels DMY in the display device 100 according to exemplary embodiments. In the following description, a case in which the subpixels SP have a 3T1C structure and the first scanning signal SCAN1 and the second scanning signal SCAN2 are the same scanning signals will be taken by way of example.

FIG. 11 illustrates scanning signals SCAN1 and SCAN2 supplied to the subpixels of twenty two (22) subpixel rows R(n+1) to R(n+22), as well as voltages Vg and Vs of the driving transistor Td in each of the subpixels of the 22 subpixel rows R(n+1) to R(n+22), in the 2H overlap driving and the fake data insertion driving.

Referring to FIG. 11, a scanning signal having a turn-on level period of 2H is supplied to each subpixel row of the 22 subpixel rows R(n+1) to R(n+22).

For example, the turn-on level period of each subpixel row of the 22 subpixel rows R(n+1) to R(n+22) has a length 2H. The turn-on level period 2H is comprised of a front portion 1H and a rear portion 1H. The front portion of the turn-on level period of each scanning signal is a scanning signal portion for pre-charging, while the rear portion of the turn-on level period of each scanning signal is a scanning signal portion for video data writing.

Due to the 2H overlap driving, the front portion (e.g., pre-charge period) of the turn-on level period of each scanning signal overlaps the rear portion (e.g., video data writing period) of the turn-on level period of a scanning signal supplied to the previous subpixel row. The rear portion (e.g., video data writing period) of the turn-on level period of each scanning signal overlaps the front portion (e.g., pre-charge period) of the turn-on level period of a scanning signal supplied to the next subpixel row.

However, directly before the fake data insertion, the rear portion (e.g., video data writing period) of the turn-on level period of the scanning signal supplied to each of the subpixel rows R(n+4), R(n+12), and R(n+20) does not overlap the front portion (e.g., pre-charge period) of the turn-on level period of the scanning signal supplied to each of the next subpixel rows R(n+5), R(n+13), and R(n+21).

Thus, directly before the fake data insertion, during the rear portion (e.g., video data writing period) of the turn-on level period of the scanning signal supplied to each of the subpixel rows R(n+4), R(n+12), and R(n+20), on which the video data writing is performed, the voltage Vs of the driving transistor Td is lowered from Vref+ΔV to Vref+Δ(V/2).

Here, the voltage Vg of the driving transistor Td before the fake data insertion is the video data voltage Vdata, while the voltage Vg of the driving transistor Td in the case of the fake data insertion is the fake data voltage Vfake.

In the subpixel rows R(n+4), R(n+12), and R(n+20), on which the video data writing is performed, directly before the fake data insertion, the voltage Vgs of the driving transistor Td suddenly increases during the rear portion of the turn-on level period of the scanning signal.

Accordingly, the bright stripes 700 may occur in the subpixel rows R(n+4), R(n+12), and R(n+20), on which the video data writing is performed, directly before the fake data insertion.

This will be described in more detail with reference to FIGS. 12 and 13.

FIG. 12 illustrates driving operations on a first subpixel SPa disposed in the subpixel row R(n+3), a second subpixel SPb disposed in the subpixel row R(n+4), and a third subpixel SPc disposed in the subpixel row R(n+5).

Referring to FIG. 12, the first subpixel SPa disposed in the subpixel row R(n+3), the second subpixel SPb disposed in the subpixel row R(n+4), and the third subpixel SPc disposed in the subpixel row R(n+5) are disposed in the same column, and are electrically connected to a single first data line DL1 and a single reference voltage line RVL1.

That is, the drain node or the source node of the first transistor T1, disposed in each of the first subpixel SPa, the second subpixel SPb, and the third subpixel SPc, may be electrically connected, in common, to the first data line DL1. The drain node or the source node of the first transistor T1, disposed in each of the first subpixel SPa, the second subpixel SPb, and the third subpixel SPc, may be electrically connected, in common, to the first reference voltage line RVL1.

Referring to FIGS. 11 to 13, in the video data writing performed on the first subpixel SPa disposed in the subpixel row R(n+3), the first transistor T1 in the first subpixel SPa in the subpixel row R(n+3) is turned on by the first scanning signal SCAN1 having a turn-on level. Consequently, the video data voltage Vdata, supplied to the first data line DL1, is transferred to the first node N1, corresponding to the gate node of the driving transistor Td.

At this time, the second transistor T2 in the first subpixel SPa in the subpixel row R(n+3) is turned on by the second scanning signal SCAN2 having a turn-on level, so that the reference voltage Vref, supplied to the first reference voltage line RVL1, is transferred to the second node N2, corresponding to the source node of the driving transistor Td, via the turned-on second transistor T2.

Due to the 2H overlap driving, during the video data writing on the first subpixel SPa in the subpixel row R(n+3), the pre-charge driving may be performed on the second subpixel SPb in the next subpixel row R(n+4).

That is, in the video data writing on the first subpixel SPa in the subpixel row R(n+3), the first scanning signal SCAN1 having a turn-on level is applied to the second subpixel SPb in the next subpixel row R(n+4), so that the video data voltage Vdata, supplied to the first data line DL1, is applied, as a pre-charge voltage, to the first node N1, e.g., the gate node of the driving transistor Td in the second subpixel SPb, via the turned-on first transistor T1.

At this time, the second transistor T2 in the second subpixel SPb in the subpixel row R(n+4) is turned on by the second scanning signal SCAN2 having a turn-on level, so that the reference voltage Vref, supplied to the first reference voltage line RVL1, is transferred to the second node N2, corresponding to the source node of the driving transistor Td, via the turned-on second transistor T2.

In the video data writing performed on the first subpixel SPa in the subpixel row R(n+3), a current 2*id*, produced by combining a current id supplied from the first subpixel SPa and a current id supplied from the second subpixel SPb, flows through the first reference voltage line RVL1. This consequently increases the voltage Vs of the driving transistor Td in the first subpixel SPa in the subpixel row R(n+3).

After the video data writing performed on the first subpixel SPa in the subpixel row R(n+3), the video data writing may be performed on the second subpixel SPb in the subpixel row R(n+4).

When the video data writing is being performed on the second subpixel SPb in the subpixel row R(n+4), the first transistor T1 in the second subpixel SPb in the subpixel row R(n+4) is turned on by the first scanning signal SCAN1 having a turn-on level. Consequently, the video data voltage Vdata, supplied to the first data line DL1, is transferred to the first node N1, corresponding to the gate node of the driving transistor Td, via the turned-on first transistor T1.

At this time, the second transistor T2 in the second subpixel SPb in the subpixel row R(n+4) is turned on by the second scanning signal SCAN2 having a turn-on level, so that the reference voltage Vref, supplied to the first reference voltage line RVL1, is transferred to the second node N2, corresponding to the source node of the driving transistor Td, via the turned-on second transistor T2.

Since the period, in which the video data writing is performed on the second subpixel SPb in the subpixel row R(n+4), is directly before the process of the fake data insertion driving, the pre-charge driving is not performed on the third subpixel SPc in the next subpixel row R(n+5) while the video data writing is being performed on the second subpixel SPb in the subpixel row R(n+4).

Consequently, in the video data writing on the second subpixel SPb in the subpixel row R(n+4), only the current id, supplied from the second subpixel SPb, flows through the first reference voltage line RVL1. This consequently increases the voltage Vs of the driving transistor Td in the first subpixel SPa in the subpixel row R(n+3). However, such an increase in the voltage Vs when the video data writing is performed on the second subpixel SPb in the subpixel row R(n+4) is smaller than an increase in the voltage Vs when the video data writing is performed on the first subpixel SPa in the subpixel row R(n+3).

Accordingly, directly before the fake data voltage Vfake is applied to the first data line DL1 due to the fake data insertion driving (e.g., directly before the fake data insertion period FDIP), the voltage Vgs increases while the video data writing is being performed on the second subpixel SPb in the subpixel row R(n+4).

Such an increase in the voltage Vgs may be expressed with the bright stripes 700 in the subpixel rows R(n+4), R(n+12), and R(n+20), on which the video data writing is performed, directly before the fake data insertion. A driving method for preventing such a phenomenon will be described with reference to FIGS. 14 to 16 by way of example.

Figure 14:
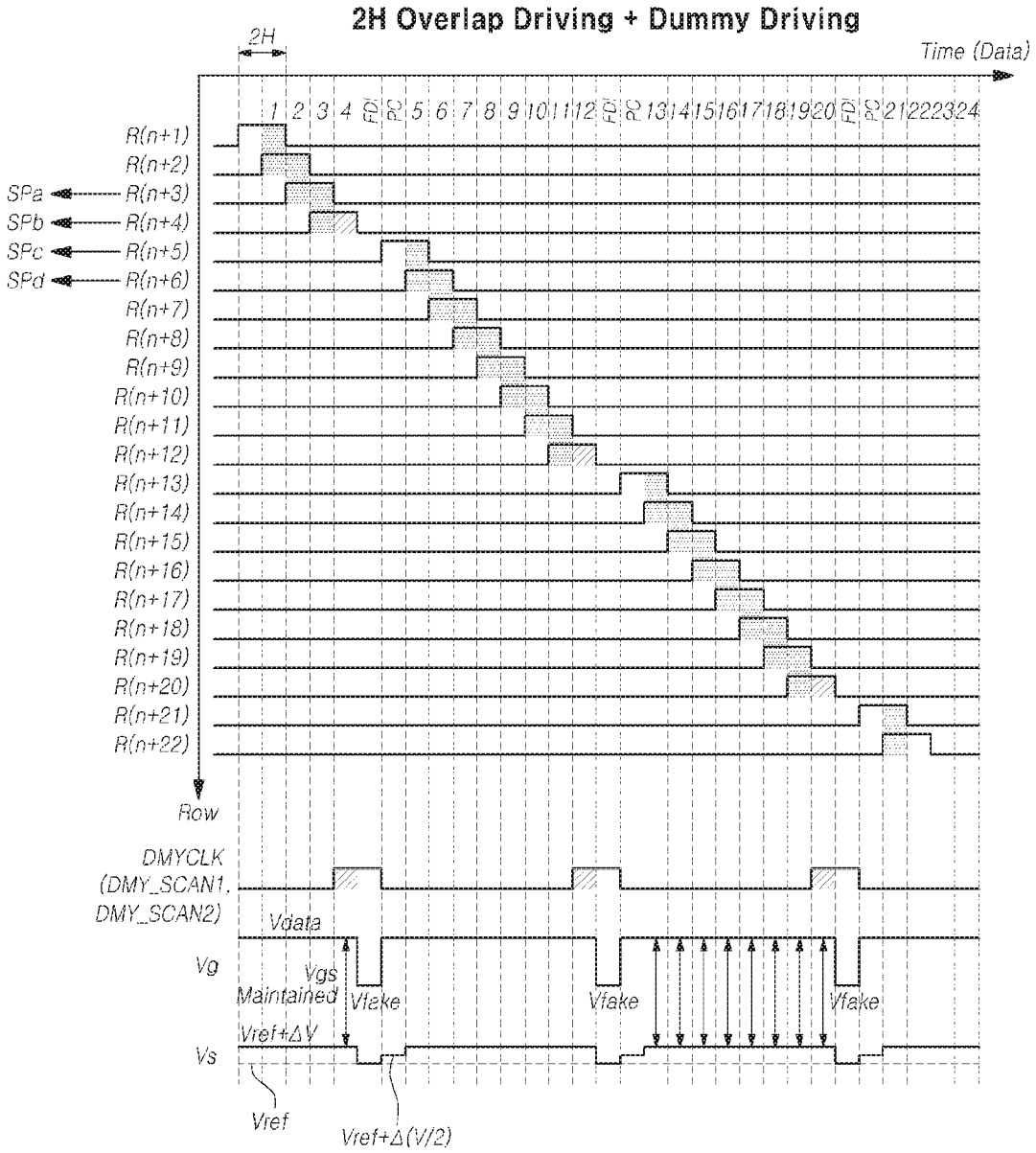
FIGS. 14 to 16 illustrate the 2H overlap driving and the fake data insertion driving using the dummy subpixels in the display device according to exemplary embodiments.
Figure 15:
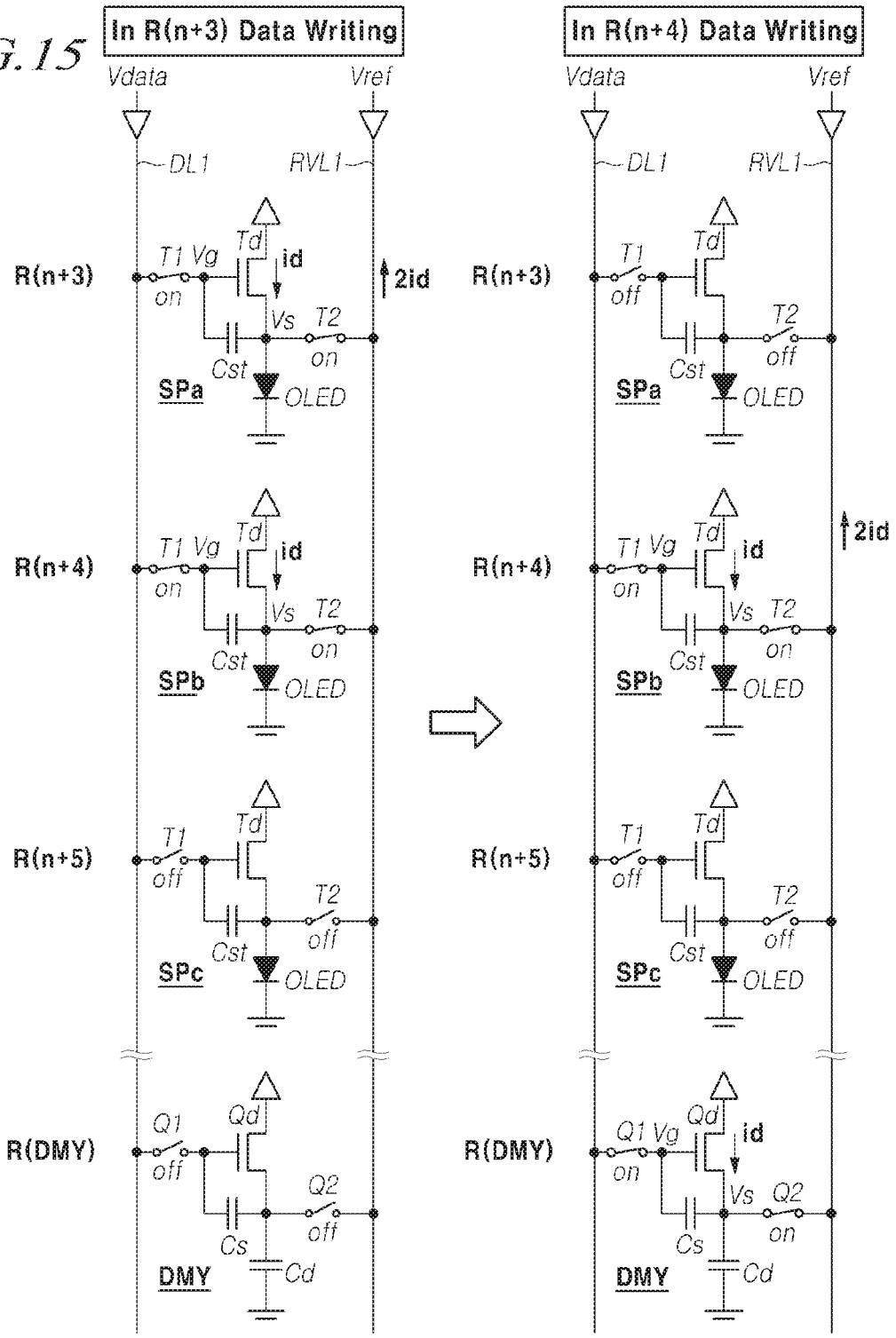
Figure 16:
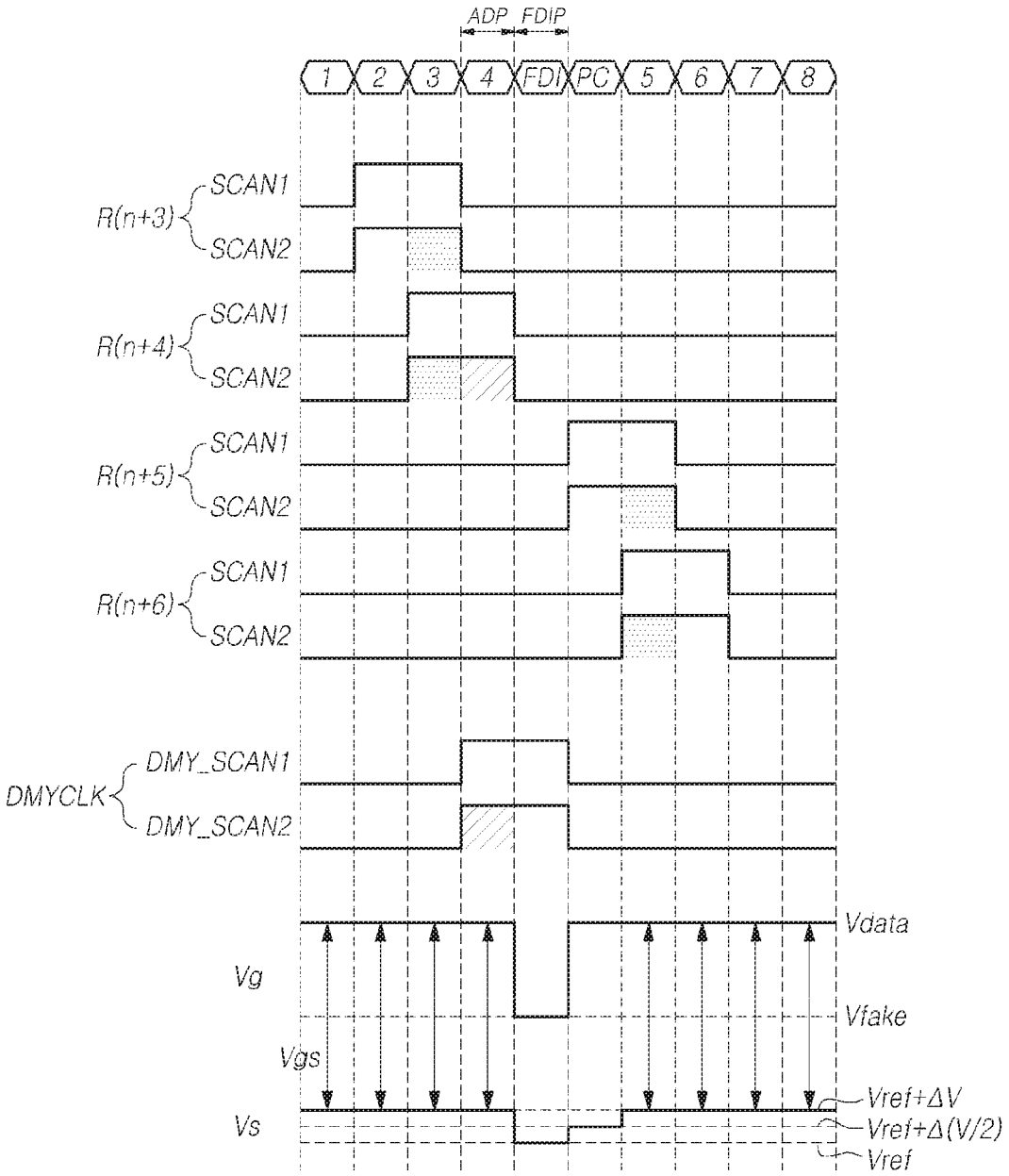

FIGS. 14 to 16 illustrate the 2H overlap driving and the fake data insertion (FDI) driving using the dummy subpixels DMY in the display device 100 according to exemplary embodiments.

FIG. 14 illustrates scanning signals SCAN1 and SCAN2 supplied to the subpixels in the 22 subpixel rows R(n+1) to R(n+22), as well as voltages Vg and Vs of the driving transistor Td in each of the subpixels in the 22 subpixel rows R(n+1) to R(n+22), in the 2H overlap driving and the fake data insertion driving.

Referring to FIG. 14, the plurality of subpixels SP disposed in the display panel 110 may be arrayed in a plurality of subpixel rows. The plurality of subpixel rows include the 22 subpixel rows R(n+1) to R(n+22). The first subpixel SPa may be present in the subpixel row R(n+3), the second subpixel SPb may be present in the subpixel row R(n+4), and the third subpixel SPc may be present in the subpixel row R(n+5). The first subpixel SPa, the second subpixel SPb, and the third subpixel SPc may be present in the same single column (e.g., a single subpixel column).

Referring to FIG. 14, each of the 22 subpixel rows R(n+1) to R(n+22) receives a scanning signal having a turn-on level period of 2H.

For example, the length of the turn-on level period of each scanning signal is 2H, and the turn-on level period 2H is comprised of a front portion 1H and a rear portion 1H. In the turn-on level period of each scanning signal, the front portion is a scanning signal portion for pre-charging (PC), and the rear portion is a scanning signal portion for video data writing.

In response to the 2H overlap driving, the front portion (e.g., pre-charge period) of the turn-on level period of each scanning signal overlaps the rear portion (e.g., video data writing period) of the turn-on level period of a scanning signal supplied to a previous subpixel row. The rear portion (e.g., video data writing period) of the turn-on level period of each scanning signal overlaps the front portion (e.g., pre-charge period) of the turn-on level period of a scanning signal supplied to the next subpixel row.

However, directly before the fake data insertion, the rear portion (e.g., video data writing period) of the turn-on level period of a scanning signal supplied to each of the subpixel rows R(n+4), R(n+12), and R(n+20), on which the video data writing is performed, does not overlap the front portion of the turn-on level period of a scanning signal supplied to each of the next subpixel rows R(n+5), R(n+13), and R(n+21).

Accordingly, to prevent the bright strips 700 from appearing, directly before the fake data insertion, the dummy subpixels DMY are driven by applying the dummy clock signal DMYCLK to the dummy subpixels DMY during the rear portion (e.g., video data writing period) of the turn-on level period of a scanning signal in each of the subpixel rows R(n+4), R(n+12), and R(n+20).

Consequently, the voltage Vs of the driving transistor Td is maintained instead of being lowered from Vref+ΔV to Vref+Δ(V/2), so that the bright stripes 700 can be prevented from appearing in each of the subpixel rows R(n+4), R(n+12), and R(n+20), on which the video data writing is being performed.

Hereinafter, a more detailed description will be provided with reference to FIGS. 15 and 16.

FIG. 15 illustrates driving operations on a first subpixel SPa disposed in the subpixel row R(n+3), a second subpixel SPb disposed in the subpixel row R(n+4), and a third subpixel SPc disposed in the subpixel row R(n+5).

The first subpixel SPa disposed in the subpixel row R(n+3), the second subpixel SPb disposed in the subpixel row R(n+4), and the third subpixel SPc disposed in the subpixel row R(n+5) may be disposed in the same column, and may be electrically connected to a single first data line DL1 and a single reference voltage line RVL1.

That is, each of the first subpixel SPa, the second subpixel SPb, and the third subpixel SPc through the first reference voltage line RVL1 may have the reference voltage Vref supplied thereto. In addition, the first subpixel SPa, the second subpixel SPb, and the third subpixel SPc may sequentially receive the video data voltage Vdata for the video data writing.

Referring to FIGS. 15 and 16, the driving period (e.g., the turn-on level period of the first and second scanning signals SCAN1 and SCAN2) of the first subpixel SPa in the subpixel row R(n+3) may overlap the driving period (e.g., the turn-on level period of the first and second scanning signals SCAN1 and SCAN2) of the second subpixel SPb in the subpixel row R(n+4).

For the fake data insertion, the driving period (e.g., the turn-on level period of the first and second scanning signals SCAN1 and SCAN2) of the second subpixel SPb in the subpixel row R(n+4) does not overlap the driving period (e.g., the turn-on level period of the first and second scanning signals SCAN1 and SCAN2) of the third subpixel SPc in the subpixel row R(n+5).

During the fake data insertion period FDIP corresponding to a period between the driving period of the second subpixel SPb in the subpixel row R(n+4) and the driving period of the third subpixel SPc in the subpixel row R(n+5), the fake data voltage Vfake may be supplied to the first data line DL1.

As described above, the display panel 110 may further include the dummy subpixel DMY arrayed in the same column (e.g., the same subpixel column) as the first subpixel SPa in the subpixel row R(n+3), the second subpixel SPb in the subpixel row R(n+4), and the third subpixel SPc in the subpixel row R(n+5).

The dummy subpixel DMY may be driven during the assist driving period ADP corresponding to a portion of the driving period of the second subpixel SPb, which does not overlap the driving period of the first subpixel SPa.

Describing the driving of the dummy subpixel DMY, the gate driver circuit 130 supplies the dummy clock signal DMYCLK (e.g., DMY_SCAN1 and DMY_SCAN2) to the dummy subpixel DMY through the signal lines 810 during the assist driving period ADP. Consequently, the dummy scanning transistor Q1 and the dummy transistor Q2 in each of the dummy subpixel DMY are turned on.

Accordingly, during the assist driving period ADP, the video data voltage Vdata, supplied to the second subpixel SPb, on which the video data writing is being performed, may be supplied to the dummy subpixel DMY through the first data line DL1.

In addition, during the assist driving period ADP, the video data voltage Vdata, supplied to the second subpixel SPb, on which the video data writing is being performed, may not be supplied to the dummy subpixel DMY through the first data line DL1, but may be changed before being supplied to the dummy subpixel DMY through the first data line DL1 in order to further reduce the appearance of the bright stripes 700.

The dummy subpixel DMY may be located opposite the portion of the display panel 110, from which the reference voltage Vref is supplied to the first reference voltage line RVL1.

For example, the locations in the display panel 110, from which the reference voltage Vref is supplied to the first reference voltage line RVL1, may be present in the areas of pads, to which the source printed circuit board SPCB is electrically connected or the data driver circuit 120 is electrically connected. Accordingly, the dummy subpixels DMY may be located in the periphery of the active area A/A of the display panel 110, opposite the areas of the pads.

During the fake data insertion period FDIP, the fake data voltage Vfake, supplied to the first data line DL1, may correspond to, for example, the black data voltage Vblk.

Since the black data voltage Vblk is used as the fake data voltage Vfake as described above, the fake driving can be easily provided.

The fake data voltage Vfake, supplied to the first data line DL1, may be supplied simultaneously to two or more subpixels SP through the first data line DL1.

The two or more subpixels SP, to which the fake data voltage Vfake is transferred, may be subpixels that have received the video data voltage Vdata before the first subpixel SPa. That is, the two or more subpixels, to which the fake data voltage Vfake is transferred, are the subpixels, on which the driving operation (including the video data writing step, the boosting step, and the light emission step) has been performed before the first subpixel SPa. That is, the emission periods EP of two or more subpixels have already passed through the light emission step.

The fake data voltage Vfake may be a voltage distinguishable or different from the video data voltage Vdata supplied to the two or more subpixels SP.

That is, the video data voltage Vdata is a data voltage for displaying a real image through the real display driving, while the fake data voltage Vfake is a data voltage for displaying a fake image unrelated to the real image, through the fake display driving (e.g., fake data insertion driving).

The video data voltage Vdata may be a data voltage variable depending on the frame, while the fake data voltage Vfake may be a data voltage that does not vary depending on the frame.

The video data voltage Vdata may be a data voltage for turning the corresponding organic light-emitting diode OLED on, while the fake data voltage Vfake may be a data voltage that does not turn the corresponding organic light-emitting diode OLED on.

In this case, the fake data voltage Vfake, supplied to the first data line DL1, may be transferred simultaneously to the two or more subpixels SP that are emitting light already. In addition, each of the two or more subpixels SP, to which the fake data voltage Vfake is transferred, may not emit light.

Referring to FIG. 15, during the assist driving period ADP, in response to the driving of the dummy subpixel DMY, the video data voltage Vdata, supplied to the second subpixel SPb in the video data writing step, may be transferred to the dummy subpixel DMY through the first data line DL1.

Accordingly, during the assist driving period ADP directly before the insertion of the fake data voltage Vfake, the video data writing may be performed on the second subpixel SPb while the second subpixel SPb in the video data writing step is maintaining the same sate as the other subpixels SPa and SPc (e.g., the state without an increase in Vgs due to no decrease in Vs).

In addition, referring to FIG. 15, before the assist driving period ADP, a current 2*id*, produced by combining a first current id generated from the first subpixel SPa and a second current id generated from the second subpixel SPb, flows through the first reference voltage line RVL1.

In addition, during the assist driving period ADP, the current 2*id*, produced by combining the second current id generated from the second subpixel SPb and the first current id generated from the first subpixel SPa may flow through the first reference voltage line RVL1.

It can be appreciated that a current 2*id flowing through the first reference voltage line RVL1, in the driving using the dummy subpixel DMY as in FIG. 15, is twice the current id flowing through the first reference voltage line RVL1, in the driving without the use of the dummy subpixel DMY as in FIG. 12, due to the current id supplied from the dummy subpixel DMY.

Accordingly, during the assist driving period ADP, the voltage Vs of the driving transistor Td in the second subpixel SPb increases to an intended level, instead of being lowered. That is, the voltage Vref+ΔV of the first reference voltage line RVL1 during the assist driving period ADP may correspond to the voltage Vref+ΔV of the first reference voltage line RVL1 before the assist driving period ADP.

Accordingly, the voltage Vgs of the driving transistor Td in the second subpixel SPb is maintained during the assist driving period ADP. That is, the voltage difference Vgs between the first node N1 and the second node N2 of the driving transistor Td in the second subpixel SPb during the assist driving period ADP may correspond to the voltage difference Vgs between the first node N1 and the second node N2 of the driving transistor Td in the second subpixel SPb before the assist driving period ADP.

Accordingly, during the assist driving period ADP, the bright stripes 700 can be prevented from appearing in the subpixel row R(n+3).

Describing the above-described driving method again, during a first frame, the driver circuit 111 driving the display panel 110 can supply the video data voltage Vdata to any second subpixel SPb in the subpixel row R(n+4) and then supply the fake data voltage Vfake to the other subpixels disposed in the same column as the second subpixel SPb.

Directly before the fake data voltage Vfake is supplied to the other subpixels disposed in the same column as the second subpixel SPb, when the video data voltage Vdata is being supplied to the second subpixel SPb, the dummy subpixel DMY, arrayed in the same column as the second subpixel SPb, may be driven.

The fake data voltage Vfake as stated above may correspond to, for example, the black data voltage Vblk.

During a single first frame, a point in time at which the video data voltage Vdata is input may vary, depending on the subpixel SP.

However, the fake data voltage Vfake may be applied simultaneously to the two or more subpixels SP. Here, the fake data voltage Vfake may be input at different points in time depending on the two or more subpixels SP.

A description will be provided again with respect to the 2H overlap driving. Here, the 2H period is a period of time during which a single subpixel row is driven. In the 2H period, the front portion is a pre-charge period, and the rear portion is a video data writing period.

Referring to FIG. 14, at a first point in time (e.g., a second period on the time axis), a first pre-charge data voltage is supplied to the first subpixel SPa through the first data line DL1.

At a second point in time (e.g., a third period on the time axis) after the first point in time, a first video data voltage Vdata may be supplied to the first subpixel SPa, and a second pre-charge data voltage may be supplied to the second subpixel SPb. Here, the second pre-charge data voltage supplied to the second subpixel SPb may be the same data voltage as the first video data voltage Vdata supplied to the first subpixel SPa.

At a third point in time (e.g., a fourth period on the time axis) after the second point in time, a second video data voltage Vdata is supplied to the second subpixel SPb through the first data line DL1. Here, the dummy subpixel DMY, arrayed in the same column as the first subpixel SPa, the second subpixel SPb, and the third subpixel SPc, is driven.

At a fourth point in time (e.g., a period on the time axis, indicated with FDI) after the third point in time, the fake data voltage Vfake may be supplied to the first data line DL1.

At a fifth point in time (e.g., a period on the time axis, indicated with PC) after the fourth point in time, a third pre-charge data voltage may be supplied to the third subpixel SPc through the first data line DL1.

At a sixth point in time (e.g., a fifth period on the time axis) after the fifth point in time, a third video data voltage Vdata may be supplied to the third subpixel SPc through the first data line and a fourth pre-charge data voltage may be supplied to the fourth subpixel through the first data line.

Since the driving is the overlap driving, the interval between the first point in time and the second point in time, the interval between the second point in time and the third point in time, the interval between the third point in time and the fourth point in time, the interval between the fourth point in time and the fifth point in time, and the interval between the fifth point in time and the sixth point in time may have the same length (e.g., 2H).

FIGS. 17 to 22 illustrate structures of the dummy subpixel DMY illustrated in FIG. 15.

Figure 17:
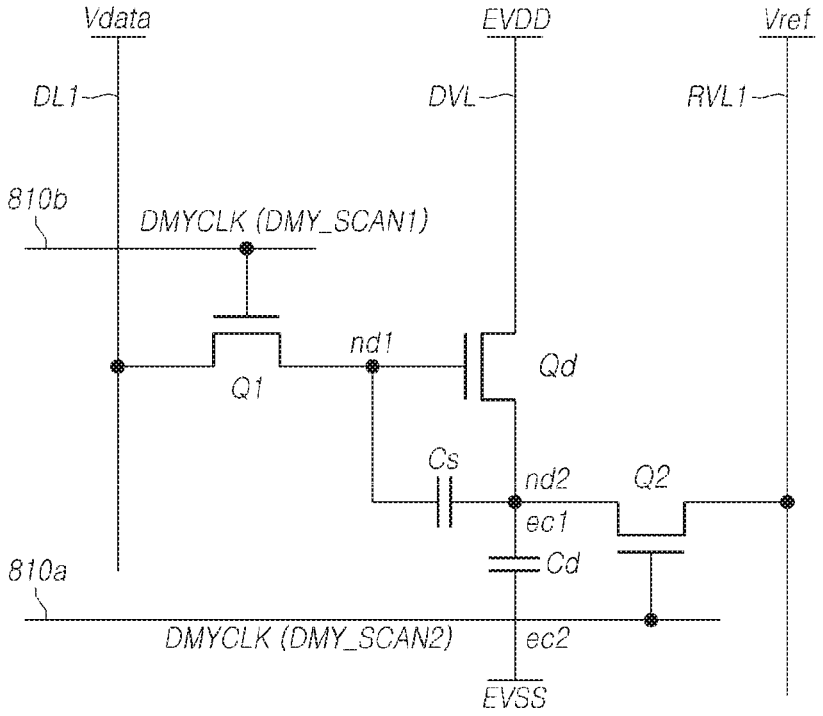
FIGS. 17 to 22 illustrate structures of the dummy subpixel illustrated in FIG. 15.
Figure 18:
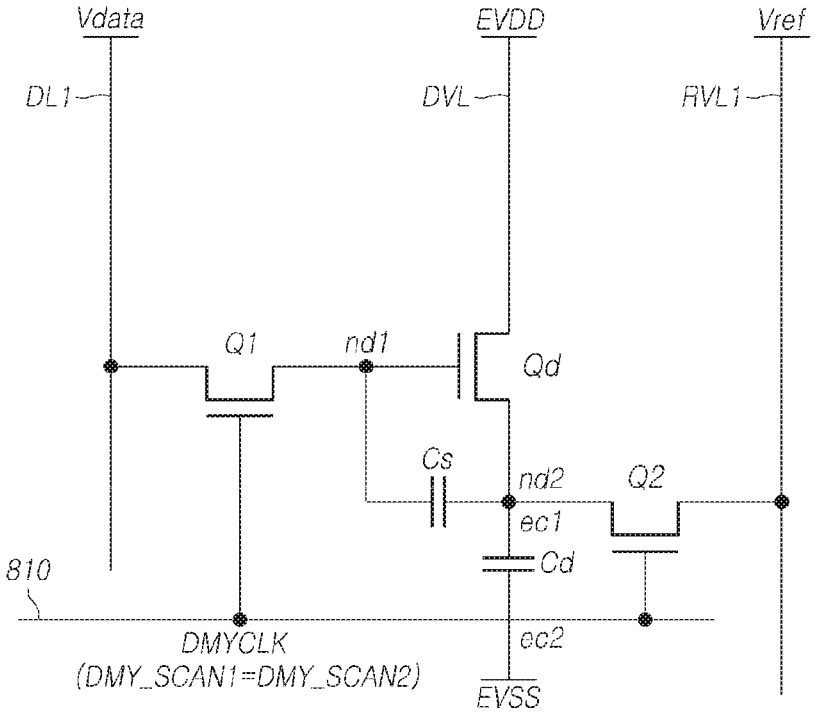
Figure 19:
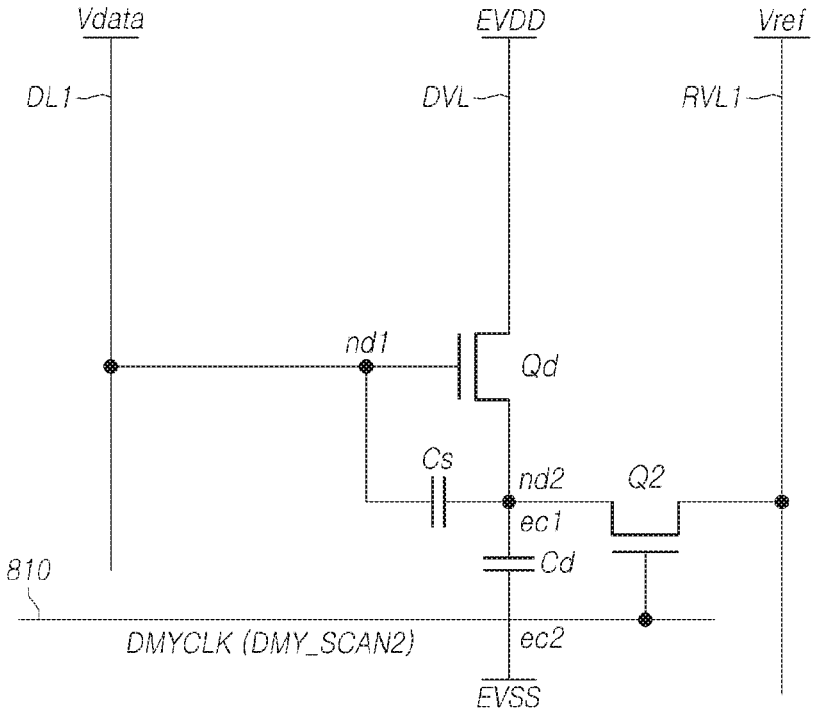

Referring to FIGS. 17 to 19, the dummy subpixel DMY may include: a dummy capacitor Cd having a first electrode ec1 and a second electrode ec2; and a dummy transistor Q2 controlled by the first dummy scanning signal DMY_SCAN2, e.g., the dummy clock signal DMYCLK for driving the dummy subpixel DMY. The dummy transistor Q2 is electrically connected between the first electrode ec1 of the dummy capacitor Cd and the first reference voltage line RVL1.

Here, the capacitance of the dummy capacitor Cd may be greater than the capacitance of the storage capacitor Cst disposed in each of the plurality of subpixels SP. For example, the capacitance of the dummy capacitor Cd may be at least twice the capacitance of the storage capacitor Cst disposed in each of the plurality of subpixels SP.

Referring to FIGS. 17 and 18, the structure of the dummy subpixel DMY may be similar to the structure of a typical subpixel SP.

Referring to FIG. 17, the dummy subpixel DMY may further include the dummy driving transistor Qd, the dummy scanning transistor Q1, and the dummy storage capacitor Cs, in addition to the dummy capacitor Cd and the dummy transistor Q2. The dummy driving transistor Qd is electrically connected between the first electrode ec1 of the dummy capacitor Cd and the driving voltage line DVL. the dummy scanning transistor Q1 is controlled by the second dummy scanning signal DMY_SCAN1, e.g., the dummy clock signal DMYCLK, and is electrically connected between a first node nd1 of the dummy driving transistor Qd and a first data line DL1. The dummy storage capacitor Cs is electrically connected between the first node nd1 and a second node nd2 of the dummy driving transistor Qd.

Referring to FIG. 17, the two dummy clock signals, e.g., the first dummy scanning signal DMY_SCAN2 and the second dummy scanning signal DMY_SCAN1, may be applied to the gate nodes of the dummy transistor Q2 and the dummy scanning transistor Q1 through separate signal lines 810*a* and 810*b*.

In contrast, referring to the structure illustrated in FIG. 18, the two dummy clock signals, e.g., the first dummy scanning signal DMY_SCAN2 and the second dummy scanning signal DMY_SCAN1, may be applied to the gate nodes of the dummy transistor Q2 and the dummy scanning transistor Q1 through a single signal line 810. That is, according to the structure illustrated in FIG. 18, the two dummy clock signals, e.g., the first dummy scanning signal DMY_SCAN2 and the second dummy scanning signal DMY_SCAN1, may be the same signals.

In this case, the number of the signal lines 810 for the driving of the dummy subpixel DMY can be reduced.

Referring to FIG. 19, the dummy subpixel DMY may further include the dummy driving transistor Qd and the dummy storage capacitor Cs, in addition to the dummy capacitor Cd and the dummy transistor Q2. The dummy driving transistor Qd is electrically connected between the first electrode ec1 of the dummy capacitor Cd and the driving voltage line DVL. The dummy storage capacitor Cs is electrically connected between the first node nd1 and the second node nd2 of the dummy driving transistor Qd.

The first node nd1 of the dummy driving transistor Qd may be electrically connected to the first data line DL1. That is, in the structure illustrated in FIG. 19, the first node nd1 of the dummy driving transistor Qd may be directly connected to the first data line DL1 without the dummy scanning transistor Q1.

Figure 20:
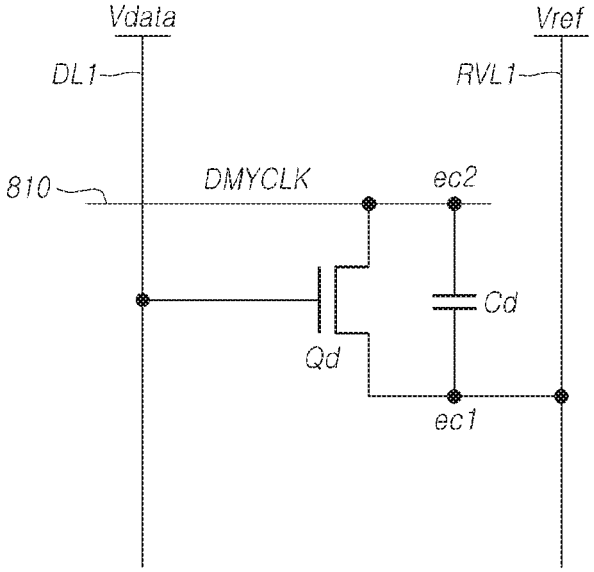
Figure 21:
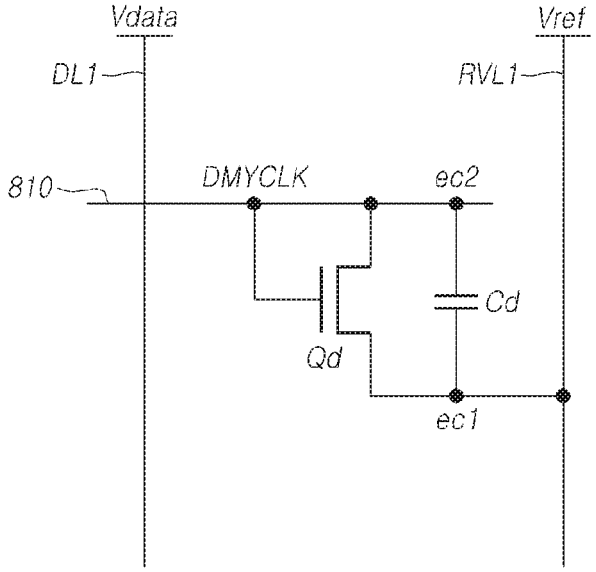
Figure 22:
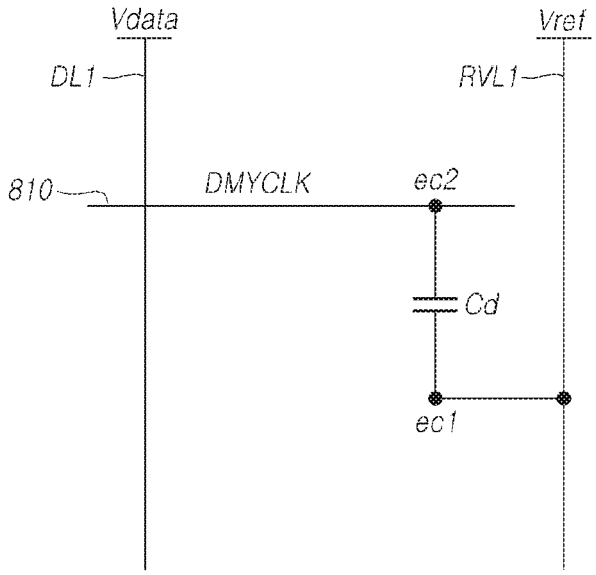

Referring to FIGS. 20 to 22, the dummy subpixel DMY may include the dummy capacitor Cd having the first electrode ec1 and the second electrode ec2. The first electrode ec1 of the dummy capacitor Cd may be electrically connected to the first reference voltage line RVL1, and the dummy clock signal DMYCLK for driving the dummy subpixel DMY may be applied to the second electrode ec2 of the dummy capacitor Cd.

The structures illustrated in FIGS. 20 to 22 may provide a simpler dummy subpixel DMY than the structures illustrated in FIGS. 17 to 19.

Referring to FIGS. 20 to 22, the capacitance of the dummy capacitor Cd may be greater than the capacitance of the storage capacitor Cst disposed in each of the plurality of subpixels SP. For example, the capacitance of the dummy capacitor Cd may be at least twice the capacitance of the storage capacitor Cst disposed in each of the plurality of subpixels SP.

Referring to FIG. 20, the dummy subpixel DMY may further include the dummy driving transistor Qd electrically connected between the first electrode ec1 and the second electrode ec2 of the dummy capacitor Cd, in addition to the dummy capacitor Cd.

The gate node of the dummy driving transistor Qd may be electrically connected to the first data line DL1.

The dummy clock signal DMYCLK may be applied to the drain node or the source node of the dummy driving transistor Qd. Here, the drain node or the source node of the dummy driving transistor Qd may correspond to the second electrode ec2 of the dummy capacitor Cd.

The first reference voltage line RVL1 may be electrically connected to the source node or the drain node of the dummy driving transistor Qd. Here, the source node or the drain node of the dummy driving transistor Qd may correspond to the first electrode ec1 of the dummy capacitor Cd.

Referring to FIG. 20, the dummy subpixel DMY may further include the dummy driving transistor Qd electrically connected between the first electrode ec1 and the second electrode ec2 of the dummy capacitor Cd, in addition to the dummy capacitor Cd.

The gate node of the dummy driving transistor Qd may be electrically connected to the drain node or the source node of the dummy driving transistor Qd.

The dummy clock signal DMYCLK may be applied to the drain node or the source node of the dummy driving transistor Qd. Here, the drain node or the source node of the dummy driving transistor Qd may correspond to the second electrode ec2 of the dummy capacitor Cd.

The first reference voltage line RVL1 may be electrically connected to the source node or the drain node of the dummy driving transistor Qd. Here, the source node or the drain node of the dummy driving transistor Qd may correspond to the first electrode ec1 of the dummy capacitor Cd.

The structures illustrated in FIGS. 20 to 22 can reduce the number of transistors and the number of capacitors than the structures illustrated in FIGS. 17 to 19, thereby providing a simpler dummy subpixel DMY.

Hereinafter, the driving method able to prevent the bright stripes 700 from appearing in second subpixel SPb, on which the video data writing is performed directly before the fake data insertion, will be briefly described again.

Figure 23:
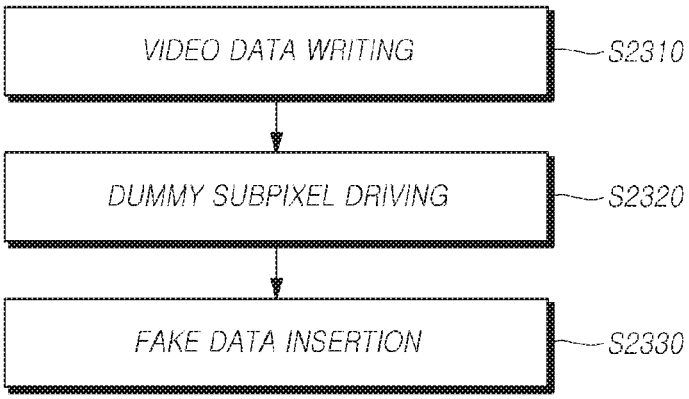
FIG. 23 illustrates a flowchart of the driving method of the display device 100 according to exemplary embodiments.

FIG. 23 illustrates a flowchart of the driving method of the display device 100 according to exemplary embodiments.

Referring to FIG. 23, the driving method of the display device 100 according to exemplary embodiments includes video data writing step S2310 and fake data insertion step S2330 performed during a single first frame time.

In the video data writing step S2310, the display device 100 may supply the video data voltage Vdata to the second subpixel SPb during a first frame.

In the fake data insertion step S2330, the display device 100 may supply the fake data voltage Vfake to the other subpixels arrayed in the same column as the second subpixel SPb during the first frame.

Referring to FIG. 23, the driving method of the display device 100 according to exemplary embodiments may include dummy subpixel driving step S2320 performed between the video data writing step S2310 and the fake data insertion step S2330 during the single first frame time.

In the dummy subpixel driving step S2320, the display device 100 can drive the dummy subpixel DMY arrayed in the same column as the second subpixel SPb, when supplying the video data voltage Vdata to the second subpixel SPb, before supplying the fake data voltage Vfake to the other subpixels.

As set forth above, according to exemplary embodiments, the display device 100 and the method of driving the same can improve the state of charge by performing overlap driving of the subpixels SP, thereby improving image quality.

According to exemplary embodiments, the display device 100 and the method of driving the same can reduce or prevent luminance differences due to image blurring or different emission periods depending on line position by fake data insertion (FDI) driving of inserting a fake image, different from real images, into every line of a plurality of lines (or every column of a plurality subpixel columns), thereby improving image quality.

According to exemplary embodiments, the display device 100 and the method of driving the same can combine the overlap driving and the fake data insertion driving, thereby further improving image quality.

According to exemplary embodiments, the display device 100 and the method of driving the same can prevent the periodic appearance of bright stripes 700, which may be caused by combined application of the overlap driving the fake data insertion driving, immediately before the insertion of fake data, thereby further improving image quality.

According to exemplary embodiments, the dummy subpixel structure can prevent the periodic appearance of bright stripes 700, which may be caused by a combined application of the overlap driving and the fake data insertion driving, immediately before the insertion of fake data, thereby further improving image quality. The display device 100 and the method of driving the same use the dummy subpixel structure in driving.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

The foregoing descriptions and the accompanying drawings have been presented in order to explain certain principles of the present disclosure by way of example. A person having ordinary skill in the art to which the present disclosure relates could make various modifications and variations by combining, dividing, substituting for, or changing the elements without departing from the principle of the present disclosure. The foregoing embodiments disclosed herein shall be interpreted as being illustrative, while not being limitative, of the principle and scope of the present disclosure. It should be understood that the scope of the present disclosure shall be defined by the appended claims and all of their equivalents fall within the scope of the present disclosure.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device comprising:

a display panel in which a plurality of data lines and a plurality of gate lines are disposed, and a plurality of subpixels are arrayed, wherein the plurality of subpixels include a first subpixel, a second subpixel, and a third subpixel arranged in a same column, a video data voltage for video display that is supplied sequentially to the first subpixel, the second subpixel, and the third subpixel through a first data line among the plurality of data lines, a driving period of the first subpixel overlaps a driving period of the second subpixel, the driving period of the second subpixel does not overlap a driving period of the third subpixel, the driving period of the first subpixel is a period in which a scanning signal having a turn-on level is supplied to the first subpixel, the driving period of the second subpixel is a period in which the scanning signal having a turn-on level is supplied to the second subpixel, and the driving period of the third subpixel is a period in which the scanning signal having a turn-on level is supplied to the third subpixel, a fake data voltage distinguishable from the video data voltage that is supplied to the first data line during a fake data insertion period between the driving period of the second subpixel and the driving period of the third subpixel that do not overlap with each other in time, the display panel further includes a dummy subpixel arrayed in the same column as the first subpixel, the second subpixel, and the third subpixel, and the dummy subpixel is driven during an assist driving period corresponding to a portion of the driving period of the second subpixel that does not overlap with the driving period of the first subpixel and the driving period of the third subpixel, wherein the display panel includes a first reference voltage line through which a reference voltage is supplied to the first subpixel, the second subpixel, the third subpixel, and the dummy subpixel, and wherein the dummy subpixel includes:

a dummy capacitor having a first electrode and a second electrode; and a dummy transistor controlled by a first dummy scanning signal, the first dummy scanning signal being a dummy clock signal for driving the dummy subpixel, the dummy transistor being electrically coupled between a first electrode of the dummy capacitor and the first reference voltage line.

2. The display device according to claim 1, wherein the dummy subpixel is located opposite of a portion in the display panel, to which the driver circuit is coupled.

3. The display device according to claim 1, wherein the fake data voltage supplied to the first data line corresponds to a black data voltage.

4. The display device according to claim 1, wherein two or more subpixels different from the first subpixel, the second subpixel, and the third subpixel are further arranged in a column in which the first to third subpixels are arranged, the two or more subpixels are sequentially driven before the first to third subpixels to be sequentially supplied with the video data voltage before the first to third subpixels, and then are supplied with a fake data voltage distinguishable from the video data voltage through the first data line.

5. The display device according to claim 4, wherein the each of two or more subpixels emits light in response to the video data voltage and does not emit light in response to the fake data voltage.

6. The display device according to claim 1, wherein, during the assist driving period, current flows in the second subpixel and the dummy subpixel.

7. The display device according to claim 1, wherein, during the assist driving period, as the dummy subpixel is driven, the video data voltage supplied to the second subpixel is transferred to the dummy subpixel through the first data line.

8. The display device according to claim 1, wherein the display panel comprises a signal line through which a dummy clock signal for driving the dummy subpixel is transferred.

9. The display device according to claim 1, wherein, before the assist driving period, a combined current of a current generated from the first subpixel and a current generated from the second subpixel flows through the first reference voltage line, and during the assist driving period, a combined current of the current generated from the second subpixel and a current generated from the dummy subpixel flows through the first reference voltage line.

10. The display device according to claim 1, wherein a voltage of the first reference voltage line during the assist driving period corresponds to a voltage of the first reference voltage line before the assist driving period.

11. The display device according to claim 1, wherein each of the first subpixel, the second subpixel, and the third subpixel comprises:

an organic light-emitting diode having a first electrode and a second electrode;

a driving transistor driving the organic light-emitting diode;

a first transistor controlled by a first scanning signal, and electrically coupled between a first node of the driving transistor and the first data line;

a second transistor controlled by a second scanning signal, and electrically coupled between a second node of the driving transistor and the first reference voltage line; and a storage capacitor electrically coupled between the first node and the second node of the driving transistor, wherein a voltage difference between the first node and the second node of the driving transistor in the second subpixel during the assist driving period corresponds to a voltage difference between the first node and the second node of the driving transistor in the second subpixel before the assist driving period.

12. The display device according to claim 1, wherein the dummy capacitor has a greater capacitance than a storage capacitor disposed in each of the plurality of subpixels.

13. The display device according to claim 1, wherein the dummy subpixel further comprises:

a dummy driving transistor electrically coupled between the first electrode of the dummy capacitor and a driving voltage line;

a dummy scanning transistor controlled by a second dummy scanning signal, the second dummy scanning signal being the dummy clock signal, the dummy scanning transistor being electrically coupled between a first node of the dummy driving transistor and the first data line; and a dummy storage capacitor electrically coupled between the first node and a second node of the dummy driving transistor.

14. The display device according to claim 1, wherein the dummy subpixel further comprises:

a dummy driving transistor electrically coupled between the first electrode of the dummy capacitor and a driving voltage line; and a dummy storage capacitor electrically coupled between a first node and a second node of the dummy driving transistor, wherein the first node of the dummy driving transistor is electrically coupled to the first data line.

15. A display device comprising:

a display panel in which a plurality of data lines and a plurality of gate lines are disposed, and a plurality of subpixels are arrayed, wherein the plurality of subpixels include a first subpixel, a second subpixel, and a third subpixel arranged in a same column, a video data voltage for video display that is supplied sequentially to the first subpixel, the second subpixel, and the third subpixel through a first data line among the plurality of data lines, a driving period of the first subpixel overlaps a driving period of the second subpixel, the driving period of the second subpixel does not overlap a driving period of the third subpixel, the driving period of the first subpixel is a period in which a scanning signal having a turn-on level is supplied to the first subpixel, the driving period of the second subpixel is a period in which the scanning signal having a turn-on level is supplied to the second subpixel, and the driving period of the third subpixel is a period in which the scanning signal having a turn-on level is supplied to the third subpixel, a data voltage distinguishable from the video data voltage is supplied to the first data line during a fake data insertion period between the driving period of the second subpixel and the driving period of the third subpixel, the display panel further includes a dummy subpixel arrayed in the same column as the first subpixel, the second subpixel, and the third subpixel, and the dummy subpixel is driven during an assist driving period corresponding to a portion of the driving period of the second subpixel that does not overlap with the driving period of the first subpixel, wherein the display panel includes a first reference voltage line through which a reference voltage is supplied to the first subpixel, the second subpixel, the third subpixel, and the dummy subpixel, and wherein the dummy subpixel further comprises a dummy capacitor having a first electrode and a second electrode, wherein the first electrode of the dummy capacitor is electrically coupled to the first reference voltage line, and a dummy clock signal for driving the dummy subpixel is applied to the second electrode of the dummy capacitor.

16. The display device according to claim 15, wherein the dummy capacitor has a greater capacitance than a storage capacitor disposed in each of the plurality of subpixels.

17. The display device according to claim 15, wherein the dummy subpixel further comprises a dummy driving transistor electrically coupled between the first electrode and the second electrode of the dummy capacitor, the gate node of the dummy driving transistor is electrically coupled to the first data line, the dummy clock signal is applied to at least one of a source node and a drain node of the dummy driving transistor, and the first reference voltage line is electrically coupled to at least one of the drain node and the source node of the dummy driving transistor.

18. The display device according to claim 15, wherein the dummy subpixel further comprises a dummy driving transistor electrically coupled between the first electrode and the second electrode of the dummy capacitor, a gate node of the dummy driving transistor is electrically coupled to at least one of a drain node and a source node of the dummy driving transistor, the dummy clock signal is applied to at least one of the drain node and the source node of the dummy driving transistor, and the first reference voltage line is electrically coupled to at least one of the source node and the drain node of the dummy driving transistor.

19. A display device comprising:

a display panel in which a plurality of data lines and a plurality of gate lines are disposed, and a plurality of subpixels are arrayed, and a driver circuit driving the display panel, wherein the plurality of subpixels constitute two or more subpixel columns, and a dummy subpixel is disposed in each of the two or more subpixel columns, and the driving circuit drives the dummy subpixel based on driving timings of subpixels included in each of the two or more subpixel columns, wherein the display panel includes a first reference voltage line through which a reference voltage is supplied to subpixels included in each of the two or more subpixel columns, and wherein the dummy subpixel includes:

a dummy capacitor having a first electrode and a second electrode; and a dummy transistor controlled by a first dummy scanning signal, the first dummy scanning signal being a dummy clock signal for driving the dummy subpixel, the dummy transistor being electrically connected between a first electrode of the dummy capacitor and the first reference voltage line.

20. The display device according to claim 19, wherein the dummy subpixel is located opposite of a portion in the display panel, to which the driver circuit is electrically coupled.

21. The display device according to claim 19, wherein, during one frame, the driver circuit supplies a video data voltage to a subpixel among the subpixels in each of the subpixel rows, and then supplies a fake data voltage to the other subpixels arranged in each of the subpixel rows, and the driver circuit drives the dummy subpixel when supplying the video data voltage to the subpixel before supplying the fake data voltage to the other subpixels.

22. The display device according to claim 21, wherein the fake data voltage corresponds to a black data voltage.

* * * * *